US010406842B2

(12) United States Patent
Bollström et al.

(10) Patent No.: US 10,406,842 B2
(45) Date of Patent: Sep. 10, 2019

(54) INKJET PRINTING METHOD

(71) Applicant: Omya International AG, Oftringen (CH)

(72) Inventors: Roger Bollström, Zofingen (CH); Joachim Schoelkopf, Oberkulm (CH); Patrick A. C. Gane, Rothrist (CH)

(73) Assignee: Omya International AG, Oftringen (CH)

( * ) Notice: Subject to any disclaimer, the term of this patent is extended or adjusted under 35 U.S.C. 154(b) by 0 days.

(21) Appl. No.: 15/551,724

(22) PCT Filed: Mar. 9, 2016

(86) PCT No.: PCT/EP2016/054954
§ 371 (c)(1),
(2) Date: Aug. 17, 2017

(87) PCT Pub. No.: WO2016/146441
PCT Pub. Date: Sep. 22, 2016

(65) Prior Publication Data

US 2018/0022135 A1 Jan. 25, 2018

Related U.S. Application Data

(60) Provisional application No. 62/135,792, filed on Mar. 20, 2015.

(30) Foreign Application Priority Data

Mar. 13, 2015 (EP) ..... 15159109

(51) Int. Cl.
*B41M 5/00* (2006.01)
*B41M 3/00* (2006.01)
(Continued)

(52) U.S. Cl.
CPC ..... *B41M 5/0017* (2013.01); *B41M 3/001* (2013.01); *B41M 5/0047* (2013.01);
(Continued)

(58) Field of Classification Search
CPC .... B41J 11/0015; B41J 2/211; B41M 5/0017; B41M 5/0047; B41M 3/001; C09D 11/54
See application file for complete search history.

(56) References Cited

U.S. PATENT DOCUMENTS 5,254,159 A 10/1993 Gundlach et al.
2003/0013806 A1 1/2003 Schut
(Continued)

FOREIGN PATENT DOCUMENTS

EP 1264868 A2 12/2002
EP 1712523 A1 10/2006
(Continued)

OTHER PUBLICATIONS

The International Search Report dated Jun. 13, 2016 for PCT/EP2016/054954.
(Continued)

*Primary Examiner* — Jason S Uhlenhake
(74) *Attorney, Agent, or Firm* — ALGM LLP; Harry J. Guttman

(57) ABSTRACT

The present invention relates to a method for manufacturing an inkjet-printed substrate, wherein a liquid treatment composition comprising at least one acid and an ink are deposited onto a substrate simultaneously or consecutively by inkjet printing, wherein the substrate comprises a coating layer comprising a salifiable alkaline or alkaline earth compound.

23 Claims, 5 Drawing Sheets

(51) Int. Cl.

| | |
|---|---|
| ***B41J 2/21*** | (2006.01) |
| ***C09D 11/54*** | (2014.01) |
| ***B41M 5/52*** | (2006.01) |
| ***B41M 5/50*** | (2006.01) |

(52) U.S. Cl.

CPC ..... *B41M 5/502* (2013.01); *B41M 5/52* (2013.01); *B41M 5/5218* (2013.01); *B41M 5/007* (2013.01); *B41M 5/0058* (2013.01); *B41M 5/0064* (2013.01); *B41M 5/0076* (2013.01)

(56) References Cited

U.S. PATENT DOCUMENTS

| | | | | |
|---|---|---|---|---|
| 2004/0210000 | A1 | 10/2004 | Schut | |
| 2011/0104410 | A1 | 5/2011 | Toles et al. | |
| 2012/0031576 | A1 | 2/2012 | Gane et al. | |
| 2014/0132661 | A1* | 5/2014 | Inumaru ..... | B41M 5/0023 347/21 |

FOREIGN PATENT DOCUMENTS

| | | | |
|---|---|---|---|
| EP | 1712597 | A1 | 10/2006 |
| EP | 2028016 | A2 | 2/2009 |
| EP | 2159258 | A1 | 3/2010 |
| EP | 2264108 | A1 | 12/2010 |
| EP | 2264109 | A2 | 12/2010 |
| EP | 2371766 | A1 | 10/2011 |
| EP | 2447213 | A1 | 5/2012 |
| EP | 2524898 | A1 | 11/2012 |
| EP | 2626388 | A1 | 8/2013 |
| WO | 0039222 | A1 | 7/2000 |
| WO | 2005121257 | A2 | 12/2005 |
| WO | 2009074492 | A1 | 6/2009 |
| WO | 2011053817 | A1 | 5/2011 |
| WO | 2013142473 | A1 | 9/2013 |

OTHER PUBLICATIONS

The Written Opinion of the International Searching Authority dated Jun. 13, 2016 for PCT/EP2016/054954.

* cited by examiner

INKJET PRINTING METHOD

CROSS-REFERENCE TO RELATED APPLICATIONS

This is a U.S. national phase of PCT Application No. PCT/EP2016/054954, filed Mar. 9, 2016, which claims priority to European Application No. 15159109.6, filed Mar. 13, 2015 and U.S. Provisional Application No. 62/135,792, filed Mar. 20, 2015.

The present invention relates to the field of inkjet printing, and more particular, to a method for manufacturing an ink-jet printed substrate, an inkjet printed substrate obtainable by said method and its use as well as a substrate with improved inkjet printability.

Alkaline or alkaline earth carbonates, and especially calcium carbonate, are widely used in pigment coating formulations for paper or paper-like materials as well as in pigment surface coatings or paints for other materials such as metal, wood or concrete. Such coatings can improve the surface properties of the underlying substrate, can have a protective effect or can add additional functionality to the substrate. Pigment coated papers, for example, are typically optically and mechanically more homogeneous, are smoother, and more readily printable than untreated papers. By selecting the appropriate mineral type for the paper coating, paper properties such as brightness, opacity, gloss, print gloss, print contrast, porosity or smoothness can be tailored.

Calcium carbonate is widely used as pigment material in coating formulations since it is non-toxic and weather-resistant, demonstrates good whiteness and low density, low interaction with other coating components. When used as surface coating for metal substrates, it can provide an anti-corrosive effect due to its alkaline pH and its low abrasivity can prevent excessive machine wear. Furthermore, calcium carbonate is available in almost any desired particle size distribution and fineness, which is especially useful for regulating physical properties such as dispersibility, gloss, gloss retention and hiding power. However, alkaline or alkaline earth carbonates such as calcium carbonate suffer from the problem that surface coatings comprising the same often show poor wettability.

Calcium carbonate based surface-coatings are, for example, used for offset papers, which require a relatively closed and somewhat hydrophobic pigment structure with low water uptake. Inkjet printing, however, especially with water-based inks require exactly the opposite structure, namely a coating that can absorb a larger amount of water very quickly, in order to avoid excessive spreading of the ink, colour-to-colour bleed, or coalescence of the ink drops. Thus, optimizing a paper for more than one print technology is not straightforward and to date different paper qualities are used in offset and inkjet printing.

Currently, so-called hybrid printing, which combines the traditional offset or flexography printing technology being well suited for high volume print production, with the very flexible inkjet print technology, becomes more and more popular because it provides the possibility to individualize packaging print or to customize the print to the target group. However, due to the contrary paper requirements of the different print methods, inkjet imprints are often only possible in low quality and poor resolution, and thus, may not allow the reproduction of one or two-dimensional bar codes or small writings. Consequently, there is an increasing demand for papers or methods that allow the combination of inkjet printing with other printing technologies such as offset printing or flexography.

EP 2 626 388 A1 relates to a composition comprising hedgehog shaped particles, at least one binder, and at least one hydrophobising agent and/or at least one hydrophilising agent, which can be used for controlling the wettability of substrate compositions.

For completeness, the applicant would like to mention the unpublished European patent application with tiling number 14 169 922.3 in its name, which relates to a method of manufacturing a surface-modified material.

However, there remains a need in the art for an inkjet printing method that can utilize conventional offset or flexography printing papers and allows the reproduction of prints with good quality at high resolution and at high productivity.

Accordingly, it is an object of the present invention to provide an inkjet printing method, which allows the production of high quality prints on print media optimized for other printing technologies such as offset printing or flexograpy. It is desirable that this method can be easily integrated into prior art methods and existing production lines. It is also desirable that the method is suitable for both small and large production volumes.

The foregoing and other objects are solved by the subject-matter as defined herein in the independent claims.

According to one aspect of the present invention, a method for manufacturing an inkjet-printed substrate is provided, comprising the following steps:

a) providing a substrate, wherein the substrate comprises on at least one side a coating layer comprising a salifiable alkaline or alkaline earth compound,
b) providing a liquid treatment composition comprising an acid,
c) providing an ink,
d) depositing the liquid treatment composition onto the coating layer by inkjet printing to form a first pattern, and
e) depositing the ink onto the coating layer by inkjet printing to form a second pattern, wherein the liquid treatment composition and the ink are deposited simultaneously or consecutively and the first pattern and the second pattern overlap at least partially.

According to a farther aspect of the present invention, an inkjet-printed substrate obtainable by the method according to the present invention is provided.

According to still a further aspect of the present invention, a method for manufacturing a substrate with improved inkjet-printability is provided, comprising the following steps:

A) providing a substrate, wherein the substrate comprises on at least one side a coating layer comprising a salifiable alkaline or alkaline earth compound,
B) providing a liquid treatment composition comprising an acid, and
C) depositing the liquid treatment composition onto the coating layer by inkjet printing to form a pattern with improved inkjet printability.

According to still a further aspect of the present invention, a substrate with improved inkjet-printability obtainable by the method according to the present invention is provided.

According to still another aspect of the present invention, a use of a substrate with improved inkjet-printability according to the present invention in inkjet printing applications is provided.

According to still another aspect of the present invention, an inkjet formulation for use in the method according to the present invention comprising a liquid treatment composition comprising an acid and an ink is provided.

According to still another aspect of the present invention, a use of the inkjet-printed substrate according to the present invention in packaging applications, in decorative applications, in artistic applications, or in visual applications is provided, preferably as wall paper, packaging, gift wrap paper, advertisement paper or poster, business card, manual, warranty sheet or card.

Advantageous embodiments of the present invention are defined in the corresponding sub-claims.

According to one embodiment the first pattern and the second pattern overlap by at least 50%, preferably at least 75%, more preferably at least 90%, even more preferably at least 95%, and most preferably at least 99%. According to another embodiment the substrate of step a) is prepared by (i) providing a substrate, (ii) applying a coating composition comprising a salifiable alkaline or alkaline earth compound on at least one side of the substrate to form a coating layer, and (iii) drying the coating layer.

According to one embodiment the substrate of step a) is selected from the group consisting of paper, cardboard, containerboard, plastic, non-wovens, cellophane, textile, wood, metal, glass, mica plate, marble, calcite, nitrocellulose, natural stone, composite stone, brick, concrete, and laminates or composites thereof, preferably paper, cardboard, containerboard, or plastic.

According to one embodiment the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or a mixtures thereof, preferably the salifiable alkaline or alkaline earth compound is an alkaline or alkaline earth carbonate being preferably selected from lithium carbonate, sodium carbonate, potassium carbonate, magnesium carbonate, calcium magnesium carbonate, calcium carbonate, or mixtures thereof, more preferably the salifiable alkaline or alkaline earth compound is calcium carbonate, and most preferably the salifiable alkaline or alkaline earth compound is a ground calcium carbonate, a precipitated calcium carbonate and/or a surface-treated calcium carbonate. According to another embodiment the salifiable alkaline or alkaline earth compound is in form of particles having a weight median particle size $d_{50}$ from 15 nm to 200 μm, preferably from 20 nm to 100 μm, more preferably from 50 nm to 50 μm, and most preferably from 100 nm to 2 μm.

According to one embodiment the acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, and mixtures thereof, preferably the acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the acid is selected from the group consisting of sulphuric acid, phosphoric acid, boric acid, suberic acid, sulphamic acid, tartaric acid, and mixtures thereof, and most preferably the acid is phosphoric acid and/or sulphuric acid. According to another embodiment the liquid treatment composition comprises the acid in an amount from 0.1 to 100 wt.-%, based on the total weight of the liquid treatment composition, preferably in an amount from 1 to 80 wt.-%, more preferably in an amount from 5 to 60 wt.-%, and most preferably in an amount from 10 to 50 wt.-%.

According to one embodiment the liquid treatment composition is deposited onto the coating layer in form of an one-dimensional bar code, a two-dimensional bar code, a three-dimensional bar code, a security mark, a number, a letter, an alphanumerical symbol, a text, a logo, an image, a shape, or a design.

It should be understood that for the purpose of the present invention, the following terms have the following meaning.

For the purpose of the present invention, an "acid" is defined as Brønsted-Lowry acid, that is to say, it is an $H_3O^+$ ion provider. In accordance with the present invention, $pK_a$, is the symbol representing the acid dissociation constant associated with a given ionisable hydrogen in a given acid, and is indicative of the natural degree of dissociation of this hydrogen from this acid at equilibrium in water at a given temperature. Such $pK_a$ values may be found in reference textbooks such as Harris, D. C. "Quantitative Chemical Analysis: 3rd Edition", 1991, W. H. Freeman & Co. (USA), ISBN 0-7167-2170-8.

The term "basis weight" as used in the present invention is determined according to DIN EN ISO 536:1996, and is defined as the weight in $g/m^2$.

For the purpose of the present invention, the term "coating layer" refers to a layer, covering, film, skin etc., formed, created, prepared etc., from a coating formulation which remains predominantly on one side of the substrate. The coating layer can be in direct contact with the surface of the substrate or, in case the substrate comprises one or more precoating layers and/or barrier layers, can be in direct contact with the top precoating layer or barrier layer, respectively.

Throughout the present document, the "drop spacing" is defined as the distance between the centres of two successive drops.

The term "liquid treatment composition" as used herein, refers to a composition in liquid from, which comprises at least one acid, and can be applied to an external surface of the substrate of the present invention by inkjet printing.

"Ground calcium carbonate" (GCC) in the meaning of the present invention is a calcium carbonate obtained from natural sources, such as limestone, marble, or chalk, and processed through a wet and/or dry treatment such as grinding, screening and/or fractionating, for example, by a cyclone or classifier.

"Modified calcium carbonate" (MCC) in the meaning of the present invention may feature a natural ground or precipitated calcium carbonate with an internal structure modification or a surface-reaction product, i.e. "surface-reacted calcium carbonate". A "surface-reacted calcium carbonate" is a material comprising calcium carbonate and insoluble, preferably at least partially crystalline, calcium salts of anions of acids on the surface. Preferably, the insoluble calcium salt extends from the surface of at least a part of the calcium carbonate. The calcium ions forming said at least partially crystalline calcium salt of said anion originate largely from the starting calcium carbonate material. MCCs are described, for example, in US 2012/0031576 A1, WO 2009/074492 A1, EP 2 264 109 A1, WO 00/39222 A1, or EP 2 264 108 A1.

"Precipitated calcium carbonate" (PCC) in the meaning of the present invention is a synthesised material, obtained by precipitation following reaction of carbon dioxide and lime in an aqueous, semi-dry or humid environment or by precipitation of a calcium and carbonate ion source in water. PCC may be in the vateritic, calcitic or aragonitic crystal form. PCCs are described, for example, in EP 2 447 213 A1, EP 2 524 898 A1, EP 2 371 766 A1, EP 1 712 597 A1, EP 1 712 523 A1, or WO 2013/142473 A1.

Throughout the present document, the "particle size" of a salifiable alkaline or alkaline earth compound is described by its distribution of particle sizes. The value $d_x$ represents the diameter relative to which x % by weight of the particles have diameters less than $d_x$. This means that the $d_{20}$ value is the particle size at which 20 wt.-% of all particles are smaller, and the $d_{75}$ value is the particle size at which 75 wt.-% of all particles are smaller. The $d_{50}$ value is thus the weight median particle size, i.e. 50 wt.-% of the total weight of all particles results from particles bigger and 50% of the total weight of all particles results from particles smaller than this particles size. For the purpose of the present invention the particle size is specified as weight median particle size $d_{50}$ unless indicated otherwise. For determining the weight median particle size $d_{50}$ value a Sedigraph can be used. The method and the instrument are known to the skilled person and are commonly used to determine grain size of fillers and pigments. The samples are dispersed using a high speed stirrer and supersonics.

A "specific surface area (SSA)" of a salifiable alkaline or alkaline earth compound in the meaning of the present invention is defined as the surface area of the compound divided by its mass. As used herein, the specific surface area is measured by nitrogen gas adsorption using the BET isotherm (ISO 9277:2010) and is specified in $m^2/g$.

For the purpose of the present invention, a "rheology modifier" is an additive that changes the rheological behaviour of a slurry or a liquid coating composition to match the required specification for the coating method employed.

A "salifiable" compound in the meaning of the present invention is defined as a compound that is capable of reacting with an acid to form a salt. Examples of salifiable compounds are alkaline or alkaline earth oxides, hydroxides, alkoxides, methylcarbonates, hydroxycarbonates, bicarbonates, or carbonates.

In the meaning of the present invention, a "surface-treated calcium carbonate" is a ground, precipitated or modified calcium carbonate comprising a treatment or coating layer, e.g. a layer of fatty acids, surfactants, siloxanes, or polymers.

In the present context, the term "substrate" is to be understood as any material having a surface suitable for printing, coating or painting on, such as paper, cardboard, containerboard, plastic, cellophane, textile, wood, metal, glass, mica plate, nitrocellulose, stone, or concrete. The mentioned examples are, however, not of limitative character.

For the purpose of the present invention, the "thickness" and "layer weight" of a layer refers to the thickness and layer weight, respectively, of the layer after the applied coating composition has been dried.

For the purpose of the present invention, the term "viscosity" or "Brookfield viscosity" refers to Brookfield viscosity. The Brookfield viscosity is for this purpose measured by a Brookfield DV-II+ Pro viscometer at 25° C.±1° C. at 100 rpm using an appropriate spindle of the Brookfield RV-spindle set and is specified in mPa·s. Based on his technical knowledge, the skilled person will select a spindle from the Brookfield RV-spindle set which is suitable for the viscosity range to be measured. For example, for a viscosity range between 200 and 800 mPa·s the spindle number 3 may be used, for a viscosity range between 400 and 1 600 mPa·s the spindle number 4 may be used, for a viscosity range between 800 and 3 200 mPa·s the spindle number 5 may be used, for a viscosity range between 1 000 and 2 000 000 mPa·s the spindle number 6 may be used, and for a viscosity range between 4 000 and 8 000 000 mPa·s the spindle number 7 may be used.

A "suspension" or "slurry" in the meaning of the present invention comprises insoluble solids and water, and optionally further additives, and usually contains large amounts of solids and, thus, is more viscous and can be of higher density than the liquid from which it is formed.

As used herein, the abbreviation "pl" refers to the unit "pico liter" and the abbreviation "fl" refers to the unit "femto liter". As known to the skilled person, 1 pico liter equals $10^{-12}$ liter and 1 femto liter equals $10^{-15}$ liter.

Where the term "comprising" is used in the present description and claims, it does not exclude other elements. For the purposes of the present invention, the term "consisting of" is considered to be a preferred embodiment of the term "comprising of". If hereinafter a group is defined to comprise at least a certain number of embodiments, this is also to be understood to disclose a group, which preferably consists only of these embodiments.

Whenever the terms "including" or "having" are used, these terms are meant to be equivalent to "comprising" as defined above.

Where an indefinite or definite article is used when referring to a singular noun, e.g. "a", "an" or "the", this includes a plural of that noun unless something else is specifically stated.

Terms like "obtainable" or "definable" and "obtained" or "defined" are used interchangeably. This e.g. means that, unless the context clearly dictates otherwise, the term "obtained" does not mean to indicate that e.g. an embodiment must be obtained by e.g. the sequence of steps following the term "obtained" even though such a limited understanding is always included by the terms "obtained" or "defined" as a preferred embodiment.

According to the present invention, a method for manufacturing an inkjet-printed substrate is provided. The method comprises the steps of (a) providing a substrate, wherein the substrate comprises on at least one side a coating layer comprising a salifiable alkaline or alkaline earth compound, (b) providing a liquid treatment composition comprising an acid, (c) providing an ink, (d) depositing the liquid treatment composition onto the coating layer by inkjet printing to form a first pattern, and (e) depositing the ink onto the coating layer by inkjet printing to form a second pattern. The liquid treatment composition and the ink are deposited simultaneously or consecutively and the first pattern and the second pattern overlap at least partially.

In the following the details and preferred embodiments of the inventive method will be set out in more detail. It is to be understood that these technical details and embodiments also apply to the inventive inkjet printed substrate and the use thereof as well as to the substrate with improved inkjet printability and the use thereof.

Method Step a)

According to step a) of the method of the present invention, a substrate is provided.

The substrate serves as a support for the coating layer and may be opaque, translucent, or transparent.

According to one embodiment, the substrate is selected from the group consisting of paper, cardboard, containerboard, plastic, non-wovens, cellophane, textile, wood, metal, glass, mica plate, marble, calcite, nitrocellulose, natural stone, composite stone, brick, concrete, and laminates or composites thereof. According to a preferred embodiment, the substrate is selected from the group consisting paper, cardboard, containerboard, or plastic. According to another embodiment, the substrate is a laminate of paper, plastic and/or metal, wherein preferably the plastic and/or metal are in form of thin foils such as for example used in Tetra Pak. However, any other material having a surface suitable for printing, coating or painting on may also be used as substrate.

According to one embodiment of the present invention, the substrate is paper, cardboard, or containerboard. Cardboard may comprise carton board or boxboard, corrugated cardboard, or non-packaging cardboard such as chromoboard, or drawing cardboard. Containerboard may encompass linerboard and/or a corrugating medium. Both linerboard and a corrugating medium are used to produce corrugated board. The paper, cardboard, or containerboard substrate can have a basis weight from 10 to 1000 g/m$^2$, from 20 to 800 g/m$^2$, from 30 to 700 g/m$^2$, or from 50 to 600 g/m$^2$. According to one embodiment, the substrate is paper, preferably having a basis weight from 10 to 400 g/m$^2$, 20 to 300 g/m$^2$, 30 to 200 g/m$^2$, 40 to 100 g/m$^2$, 50 to 90 g/m$^2$, 60 to 80 g/m$^2$, or about 70 g/m$^2$.

According to another embodiment, the substrate is a plastic substrate. Suitable plastic materials are, for example, polyethylene, polypropylene, polyvinylchloride, polyesters, polycarbonate resins, or fluorine-containing resins, preferably polypropylene. Examples for suitable polyesters are poly(ethylene terephthalate), polyethylene naphthalate) or poly(ester diacetate). An example for a fluorine-containing resins is poly(tetrafluoro ethylene). The plastic substrate may be filled by a mineral filler, an organic pigment, an inorganic pigment, or mixtures thereof.

The substrate may consist of only one layer of the above-mentioned materials or may comprise a layer structure having several sublayers of the same material or different materials. According to one embodiment, the substrate is structured by one layer. According to another embodiment the substrate is structured by at least two sublayers, preferably three, five, or seven sublayers, wherein the sublayers can have a flat or non-flat structure, e.g. a corrugated structure. Preferably the sublayers of the substrate are made from paper, cardboard, containerboard and/or plastic.

The substrate may be permeable or impermeable for solvents, water, or mixtures thereof. According to one embodiment, the substrate is impermeable for water, solvents, or mixtures thereof. Examples for solvents aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

According to the present invention, the substrate provided in step a) comprises on at least one side a coating layer comprising a salifiable alkaline or alkaline earth compound. The coating layer may be in direct contact with the surface of the substrate. In case the substrate already comprises one or more precoating layers and/or barrier layers (which will be described in more detail further below), the coating layer may be in direct contact with the top precoating layer or barrier layer, respectively.

According to one embodiment, the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or a mixtures thereof. Preferably, the salifiable alkaline or alkaline earth compound is an alkaline or alkaline earth carbonate.

The alkaline or alkaline earth carbonate may be selected from lithium carbonate, sodium carbonate, potassium carbonate, magnesium carbonate, calcium magnesium carbonate, calcium carbonate, or mixtures thereof. According to a preferred embodiment, the alkaline or alkaline earth carbonate is calcium carbonate, and more preferably the alkaline or alkaline earth carbonate is a ground calcium carbonate, a precipitated calcium carbonate and/or a surface-treated calcium carbonate.

Ground (or natural) calcium carbonate (GCC) is understood to be a naturally occurring form of calcium carbonate, mined from sedimentary rocks such as limestone or chalk, or from metamorphic marble rocks. Calcium carbonate is known to exist as three types of crystal polymorphs: calcite, aragonite and vaterite. Calcite, the most common crystal polymorph, is considered to be the most stable crystal form of calcium carbonate. Less common is aragonite, which has a discrete or clustered needle orthorhombic crystal structure. Vaterite is the rarest calcium carbonate polymorph and is generally unstable. Natural calcium carbonate is almost exclusively of the calcitic polymorph, which is said to be trigonal-rhombohedral and represents the most stable of the calcium carbonate polymorphs. The term "source" of the calcium carbonate in the meaning of the present invention refers to the naturally occurring mineral material from which the calcium carbonate is Obtained. The source of the calcium carbonate may comprise further naturally occurring components such as magnesium carbonate, alumino silicate etc.

According to one embodiment of the present invention the GCC is obtained by dry grinding. According to another embodiment of the present invention the GCC is obtained by wet grinding and optionally subsequent drying.

In general, the grinding step can be carried out with any conventional grinding device, for example, under conditions such that comminution predominantly results from impacts with a secondary body, i.e. in one or more of: a ball mill, a rod mill, a vibrating mill, a roll crusher, a centrifugal impact mill, a vertical bead mill, an attrition mill, a pin mill, a hammer mill, a pulveriser, a shredder, a de-clumper, a knife cutter, or other such equipment known to the skilled man. In case the calcium carbonate containing mineral material comprises a wet ground calcium carbonate containing mineral material, the grinding step may be performed under conditions such that autogenous grinding takes place and/or by horizontal ball milling, and/or other such processes known to the skilled man. The wet processed ground calcium carbonate containing mineral material thus obtained may be washed and dewatered by well-known processes, e.g. by flocculation, centrifugation, filtration or forced evaporation prior to drying. The subsequent step of drying may be carried out in a single step such as spray drying, or in at least two steps. It is also common that such a mineral material undergoes a beneficiation step (such as a flotation, bleaching or magnetic separation step) to remove impurities.

According to one embodiment of the present invention, the ground calcium carbonate is selected from the group consisting of marble, chalk, dolomite, limestone and mixtures thereof.

According to one embodiment of the present invention, the calcium carbonate comprises one type of ground calcium carbonate. According to another embodiment of the present invention, the calcium carbonate comprises a mixture of two or more types of ground calcium carbonates selected from different sources.

"Precipitated calcium carbonate" (PCC) in the meaning of the present invention is a synthesized material, generally obtained by precipitation following reaction of carbon dioxide and lime in an aqueous environment or by precipitation of a calcium and carbonate ion source in water or by precipitation of calcium and carbonate ions, for example $CaCl_2$ and $Na_2CO_3$, out of solution. Further possible ways of producing PCC are the lime soda process, or the Solvay process in which PCC is a by-product of ammonia production. Precipitated calcium carbonate exists in three primary crystalline forms: calcite, aragonite and vaterite, and there are many different polymorphs (crystal habits) for each of these crystalline forms. Calcite has a trigonal structure with typical crystal habits such as scalenohedral (S-PCC), rhombohedral (R-PCC), hexagonal prismatic, pinacoidal, colloidal (C-PCC), cubic, and prismatic (P-PCC). Aragonite is an orthorhombic structure with typical crystal habits of twinned hexagonal prismatic crystals, as well as a diverse assortment of thin elongated prismatic, curved bladed, steep pyramidal, chisel shaped crystals, branching tree, and coral or wormlike form. Vaterite belongs to the hexagonal crystal system. The obtained FCC slurry can be mechanically dewatered and dried.

According to one embodiment of the present invention, the calcium carbonate comprises one precipitated calcium carbonate. According to another embodiment of the present invention, the calcium carbonate comprises a mixture of two or more precipitated calcium carbonates selected from different crystalline forms and different polymorphs of precipitated calcium carbonate. For example, the at least one precipitated calcium carbonate may comprise one PCC selected from S-PCC and one FCC selected from R-PCC.

The salifiable alkaline or alkaline earth compound may be surface-treated material, for example, a surface-treated calcium carbonate.

A surface-treated calcium carbonate may feature a around calcium carbonate, a modified calcium carbonate, or a precipitated calcium carbonate comprising a treatment or coating layer on its surface. For example, the calcium carbonate may be treated or coated with a hydrophobising agent such as, e.g., aliphatic carboxylic acids, salts or esters thereof, or a siloxane. Suitable aliphatic acids are, for example, $C_5$ to $C_{28}$ fatty acids such as stearic acid, palmitic acid, myristic acid, lauric acid, or a mixture thereof. The calcium carbonate may also be treated or coated to become cationic or anionic with, for example, a polyacrylate or polydiallyldimethylammonium chloride (polyDADMAC). Surface-treated calcium carbonates are, for example, described in EP 2 159 258 A1 or WO 2005/121257 A1.

According to one embodiment, the surface-treated calcium carbonate comprises a treatment layer or surface coating obtained from the treatment with fatty acids, their salts, their esters, or combinations thereof, preferably from the treatment with aliphatic $C_5$ to $C_{28}$ fatty acids, their salts, their esters, or combinations thereof, and more preferably from the treatment with ammonium stearate, calcium stearate, stearic acid, palmitic acid, myristic acid, lauric acid, or mixtures thereof. According to an exemplary embodiment, the alkaline or alkaline earth carbonate is a surface-treated calcium carbonate, preferably a ground calcium carbonate comprising a treatment layer or surface coating obtained from the treatment with a fatty acid, preferably stearic acid.

In one embodiment, the hydrophobising agent is an aliphatic carboxylic acid having a total amount of carbon atoms from C4 to C24 and/or reaction products thereof. Accordingly, at least a part of the accessible surface area of the calcium carbonate particles is covered by a treatment layer comprising an aliphatic carboxylic acid having a total amount of carbon atoms from C4 to C24 and/or reaction products thereof. The term "accessible" surface area of a material refers to the part of the material surface which is in contact with a liquid phase of an aqueous solution, suspension, dispersion or reactive molecules such as a hydrophobising agent.

The term "reaction products" of the aliphatic carboxylic acid in the meaning of the present invention refers to products obtained by contacting the at least one calcium carbonate with the at least one aliphatic carboxylic acid. Said reaction products are formed between at least a part of the applied at least one aliphatic carboxylic acid and reactive molecules located at the surface of the calcium carbonate particles.

The aliphatic carboxylic acid in the meaning of the present invention may be selected from one or more straight chain, branched chain, saturated, unsaturated and/or alicyclic carboxylic acids. Preferably, the aliphatic carboxylic acid is a monocarboxylic acid, i.e. the aliphatic carboxylic acid is characterized in that a single carboxyl group is present. Said carboxyl group is placed at the end of the carbon skeleton.

In one embodiment of the present invention, the aliphatic carboxylic acid is selected from saturated unbranched carboxylic acids, that is to say the aliphatic carboxylic acid is preferably selected from the group of carboxylic acids consisting of pentanoic acid, hexanoic acid, heptanoic acid, octanoic acid, nonanoic acid, decanoic acid, undecanoic acid, lauric acid, tridecanoic acid, myristic acid, pentadecanoic acid, palmitic acid, heptadecanoic acid, stearic acid, nonadecanoic acid, arachidic acid, heneicosylic acid, behenic acid, tricosylic acid, lignoceric acid and mixtures thereof.

In another embodiment of the present invention, the aliphatic carboxylic acid is selected from the group consisting of octanoic acid, decanoic acid, lauric acid, myristic acid, palmitic acid, stearic acid, arachidic acid and mixtures thereof. Preferably, the aliphatic carboxylic acid is selected from the group consisting of myristic acid, palmitic acid, stearic acid and mixtures thereof. For example, the aliphatic carboxylic acid is stearic acid.

Additionally or alternatively, the hydrophobising agent can be at least one mono-substituted succinic anhydride consisting of succinic anhydride mono-substituted with a group selected from a linear, branched, aliphatic and cyclic group having a total amount of carbon atoms from C2 to C30 in the substituent. Accordingly, at least a part of the accessible surface area of the calcium carbonate particles is covered by a treatment layer comprising at least one mono-substituted succinic anhydride consisting of succinic anhydride mono-substituted with a group selected from a linear, branched, aliphatic and cyclic group having a total amount of carbon atoms from C2 to C30 in the substituent and/or reaction products thereof. It will be appreciated by the skilled person that in case the at least one mono-substituted succinic anhydride consists of succinic anhydride mono-substituted with a branched and/or cyclic group, said group will have a total amount of carbon atoms from C3 to C30 in the substituent.

The term "reaction products" of the mono-substituted succinic anhydride in the meaning of the present invention refers to products obtained by contacting the calcium carbonate with the at least one mono-substituted succinic anhydride. Said reaction products are formed between at least a part of the applied at least one mono-substituted succinic anhydride and reactive molecules located at the surface of the calcium carbonate particles.

For example, the at least one mono-substituted succinic anhydride consists of succinic anhydride mono-substituted with one group being a linear alkyl group having a total amount of carbon atoms from C2 to C30, preferably from C3 to C20 and most preferably from C4 to C18 in the substituent or a branched alkyl group having a total amount of carbon atoms from C3 to C30, preferably from C3 to C20 and most preferably from C4 to C18 in the substituent.

For example, the at least one mono-substituted succinic anhydride consists of succinic anhydride mono-substituted with one group being a linear alkyl group having a total amount of carbon atoms from C2 to C30, preferably from C3 to C20 and most preferably from C4 to C18 in the substituent. Additionally or alternatively, the at least one mono-substituted succinic anhydride consists of succinic anhydride mono-substituted with one group being a branched alkyl group having a total amount of carbon atoms from C3 to C30, preferably from C3 to C20 and most preferably from C4 to C18 in the substituent.

The term "alkyl" in the meaning of the present invention refers to a linear or branched, saturated organic compound composed of carbon and hydrogen. In other words, "alkyl mono-substituted succinic anhydrides" are composed of linear or branched, saturated hydrocarbon chains containing a pendant succinic anhydride group.

In one embodiment of the present invention, the at least one mono-substituted succinic anhydride is at least one linear or branched alkyl mono-substituted succinic anhydride. For example, the at least one alkyl mono-substituted succinic anhydride is selected from the group comprising ethylsuccinic anhydride, propylsuccinic anhydride, butylsuccinic anhydride, triisobutyl succinic anhydride, pentylsuccinic anhydride, hexylsuccinic anhydride, heptylsuccinic anhydride, octylsuccinic anhydride, nonylsuccinic anhydride, decyl succinic anhydride, dodecyl succinic anhydride, hexadecanyl succinic anhydride, octadecanyl succinic anhydride, and mixtures thereof.

It is appreciated that e.g. the term "butylsuccinic anhydride" comprises linear and branched butylsuccinic anhydride(s). One specific example of linear butylsuccinic anhydride(s) is n-butylsuccinic anhydride. Specific examples of branched butylsuccinic anhydride(s) are iso-butylsuccinic anhydride, sec-butylsuccinic anhydride and/or tort-butylsuccinic anhydride. Furthermore, it is appreciated that e.g. the term "hexadecanyl succinic anhydride" comprises linear and branched hexadecanyl succinic anhydride(s). One specific example of linear hexadecanyl succinic anhydride(s) is n-hexadecanyl succinic anhydride. Specific examples of branched hexadecanyl succinic anhydride(s) are 14-methylpentadecanyl succinic anhydride, 13-methylpentadecanyl succinic anhydride, 12-methylpentadecanyl succinic anhydride, 11-methylpentadecanyl succinic anhydride, 10-methylpentadecanyl succinic anhydride, 9-methylpentadecanyl succinic anhydride, 8-methylpentadecanyl succinic anhydride, 7-methylpentadecanyl succinic anhydride, 6-methylpentadecanyl succinic anhydride, 5-methylpentadecanyl succinic anhydride, 4-methylpentadecanyl succinic anhydride, 3-methylpentadecanyl succinic anhydride, 2-methylpentadecanyl succinic anhydride, 1-methylpentadecanyl succinic anhydride, 13-ethylbutadecanyl succinic anhydride, 12-ethylbutadecanyl succinic anhydride, 11-ethylbutadecanyl succinic anhydride, 10-ethylbutadecanyl succinic anhydride, 9-ethylbutadecanyl succinic anhydride, 8-ethylbutadecanyl succinic anhydride, 7-ethylbutadecanyl succinic anhydride, 6-ethylbutadecanyl succinic anhydride, 5-ethylbutadecanyl succinic anhydride, 4-ethylbutadecanyl succinic anhydride, 3-ethylbutadecanyl succinic anhydride, 2-ethylbutadecanyl succinic anhydride, 1-ethylbutadecanyl succinic anhydride, 2-butyldodecanyl succinic anhydride, 1-hexyldecanyl succinic anhydride, 1-hexyl-2-decanyl succinic anhydride, 2-hexyldecanyl succinic anhydride, 6,12-dimethylbutadecanyl succinic anhydride, 2,2-diethyldodecanyl succinic anhydride, 4,8,12-trimethyltridecanyl succinic anhydride, 2,2,4,6,8-pentamethylundecanyl succinic anhydride, 2-ethyl-4-methyl-2-(2-methylpentyl)-heptyl succinic anhydride and/or 2-ethyl-4,6-dimethyl-2-propylnonyl succinic anhydride.

Furthermore, it is appreciated that e.g. the term "octadecanyl succinic anhydride" comprises linear and branched octadecanyl succinic anhydride(s). One specific example of linear octadecanyl succinic anhydride(s) is n-octadecanyl succinic anhydride. Specific examples of branched hexadecanyl succinic anhydride(s) are 16-methylheptadecanyl succinic anhydride, 15-methyltheptadecanyl succinic anhydride, 14-methylheptadecanyl succinic anhydride, 13-methylheptadecanyl succinic anhydride, 12-methylheptadecanyl succinic anhydride, 11-methylheptadecanyl succinic anhydride, 10-methylheptadecanyl succinic anhydride, 9-methylheptadecanyl succinic anhydride, 8-methylheptadecanyl succinic anhydride, 7-methylheptadecanyl succinic anhydride, 6-methylheptadecanyl succinic anhydride, 5-methylheptadecanyl succinic anhydride, 4-methylheptadecanyl succinic anhydride, 3-methylheptadecanyl succinic anhydride, 2-methylheptadecanyl succinic anhydride, 1-methylheptadecanyl succinic anhydride, 14-ethylhexadecanyl succinic anhydride, 13-ethylhexadecanyl succinic anhydride, 12-ethylhexadecanyl succinic anhydride, 11-ethylhexadecanyl succinic anhydride, 10-ethylhexadecanyl succinic anhydride, 9-ethylhexadecanyl succinic anhydride, 8-ethylhexadecanyl succinic anhydride, 7-ethylhexadecanyl succinic anhydride, 6-ethylhexadecanyl succinic anhydride, 5-ethylhexadecanyl succinic anhydride, 4-ethylhexadecanyl succinic anhydride, 3-ethylhexadecanyl succinic anhydride, 2-ethylhexadecanyl succinic anhydride, 1-ethylhexadecanyl succinic anhydride, 2-hexyldodecanyl succinic anhydride, 2-heptylundecanyl succinic anhydride, iso-octadecanyl succinic anhydride and/or 1-octyl-2-decanyl succinic anhydride.

In one embodiment of the present invention, the at least one alkyl mono-substituted succinic anhydride is selected from the group comprising butylsuccinic anhydride, hexylsuccinic anhydride, heptylsuccinic anhydride, octylsuccinic anhydride, hexadecanyl succinic anhydride, octadecanyl succinic anhydride, and mixtures thereof.

In one embodiment of the present invention, the at least one mono-substituted succinic anhydride is one kind of alkyl mono-substituted succinic anhydride. For example, the one alkyl mono-substituted succinic anhydride is butylsuccinic anhydride. Alternatively, the one alkyl mono-substituted succinic anhydride is hexylsuccinic anhydride. Alternatively, the one alkyl mono-substituted succinic anhydride is heptylsuccinic anhydride or octylsuccinic anhydride. Alternatively, the one alkyl mono-substituted succinic anhydride is hexadecanyl succinic anhydride. For example, the one alkyl mono-substituted succinic anhydride is linear hexadecanyl succinic anhydride such as n-hexadecanyl succinic anhydride or branched hexadecanyl succinic anhydride such as 1-hexyl-2-decanyl succinic anhydride.

Alternatively, the one alkyl mono-substituted succinic anhydride is octadecanyl succinic anhydride. For example, the one alkyl mono-substituted succinic anhydride is linear octadecanyl succinic anhydride such as n-octadecanyl succinic anhydride or branched octadecanyl succinic anhydride such as iso-octadecanyl succinic anhydride or 1-octyl-2-decanyl succinic anhydride.

In one embodiment of the present invention, the one alkyl mono-substituted succinic anhydride is butylsuccinic anhydride such as n-butylsuccinic anhydride.

In one embodiment of the present invention, the at least one mono-substituted succinic anhydride is a mixture of two or more kinds of alkyl mono-substituted succinic anhydrides.

For example, the at least one mono-substituted succinic anhydride is a mixture of two or three kinds of alkyl mono-substituted succinic anhydrides.

In one embodiment of the present invention, the at least one mono-substituted succinic anhydride consists of succinic anhydride mono-substituted with one group being a linear alkenyl group having a total amount of carbon atoms from C2 to C30, preferably from C3 to C20 and most preferably from C4 to C18 in the substituent or a branched alkenyl group having a total amount of carbon atoms from C3 to C30, preferably from C4 to C20 and most preferably from C4 to C18 in the substituent.

The term "alkenyl" in the meaning of the present invention refers to a linear or branched, unsaturated organic compound composed of carbon and hydrogen. Said organic compound further contains at least one double bond in the substituent, preferably one double bond. In other words, "alkenyl mono-substituted succinic anhydrides" are composed of linear or branched, unsaturated hydrocarbon chains containing a pendant succinic anhydride group, it is appreciated that the term "alkenyl" in the meaning of the present invention includes the cis and trans isomers.

In one embodiment of the present invention, the at least one mono-substituted succinic anhydride is at least one linear or branched alkenyl mono-substituted succinic anhydride. For example, the at least one alkenyl mono-substituted succinic anhydride is selected from the group comprising ethenylsuccinic anhydride, propenylsuccinic anhydride, butenylsuccinic anhydride, triisobutenyl succinic anhydride, pentenylsuccinic anhydride, hexenylsuccinic anhydride, heptenylsuccinic anhydride, octenylsuccinic anhydride, nonenylsuccinic anhydride, decenyl succinic anhydride, dodecenyl succinic anhydride, hexadecenyl succinic anhydride, octadecenyl succinic anhydride, and mixtures thereof.

Accordingly, it is appreciated that e.g. the term "hexadecenyl succinic anhydride" comprises linear and branched hexadecenyl succinic anhydride(s). One specific example of linear hexadecenyl succinic anhydride(s) is n-hexadecenyl succinic anhydride such as 14-hexadecenyl succinic anhydride, 13-hexadecenyl succinic anhydride, 12-hexadecenyl succinic anhydride, 11-hexadecenyl succinic anhydride, 10-hexadecenyl succinic anhydride, 9-hexadecenyl succinic anhydride, 8-hexadecenyl succinic anhydride, 7-hexadecenyl succinic anhydride, 6-hexadecenyl succinic anhydride, 5-hexadecenyl succinic anhydride, 4-hexadecenyl succinic anhydride, 3-hexadecenyl succinic anhydride and/or 2-hexadecenyl succinic anhydride. Specific examples of branched hexadecenyl succinic anhydride(s) are 14-methyl-9-pentadecenyl succinic anhydride, 14-methyl-2-pentadecenyl succinic anhydride, 1-hexyl-2-decenyl succinic anhydride and/or iso-hexadecenyl succinic anhydride.

Furthermore, it is appreciated that e.g. the term "octadecenyl succinic anhydride" comprises linear and branched octadecenyl succinic anhydride(s). One specific example of linear octadecenyl succinic anhydride(s) is n-octadecenyl succinic anhydride such as 16-octadecenyl succinic anhydride, 15-octadecenyl succinic anhydride, 14-octadecenyl succinic anhydride, 13-octadecenyl succinic anhydride, 12-octadecenyl succinic anhydride, 11-octadecenyl succinic anhydride, 10-octadecenyl succinic anhydride, 9-octadecenyl succinic anhydride, 8-octadecenyl succinic anhydride, 7-octadecenyl succinic anhydride, 6-octadecenyl succinic anhydride, 5-octadecenyl succinic anhydride, 4-octadecenyl succinic anhydride, 3-octadecenyl succinic anhydride and/or 2-octadecenyl succinic anhydride. Specific examples of branched octadecenyl succinic anhydride(s) are 16-methyl-9-heptadecenyl succinic anhydride, 16-methyl-7-heptadecenyl succinic anhydride, 1-octyl-2-decenyl succinic anhydride and/or iso-octadecenyl succinic anhydride.

In one embodiment of the present invention, the at least one alkenyl mono-substituted succinic anhydride is selected from the group comprising hexenylsuccinic anhydride, octenylsuccinic anhydride, hexadecenyl succinic anhydride, octadecenyl succinic anhydride, and mixtures thereof.

In one embodiment of the present invention, the at least one mono-substituted succinic anhydride is one alkenyl mono-substituted succinic anhydride. For example, the one alkenyl mono-substituted succinic anhydride is hexenylsuccinic anhydride. Alternatively, the one alkenyl mono-substituted succinic anhydride is octenylsuccinic anhydride. Alternatively, the one alkenyl mono-substituted succinic anhydride is hexadecenyl succinic anhydride. For example, the one alkenyl mono-substituted succinic anhydride is linear hexadecenyl succinic anhydride such as n-hexadecenyl succinic anhydride or branched hexadecenyl succinic anhydride such as 1-hexyl-2-decenyl succinic anhydride. Alternatively, the one alkenyl mono-substituted succinic anhydride is octadecenyl succinic anhydride. For example, the one alkyl mono-substituted succinic anhydride is linear octadecenyl succinic anhydride such as n-octadecenyl succinic anhydride or branched octadecenyl succinic anhydride such iso-octadecenyl succinic anhydride, or 1-octyl-2-decenyl succinic anhydride.

In one embodiment of the present invention, the one alkenyl mono-substituted succinic anhydride is linear octadecenyl succinic anhydride such as n-octadecenyl succinic anhydride. In another embodiment of the present invention, the one alkenyl mono-substituted succinic anhydride is linear octenylsuccinic anhydride such as n-octenylsuccinic anhydride.

If the at least one mono-substituted succinic anhydride is one alkenyl mono-substituted succinic anhydride, it is appreciated that the one alkenyl mono-substituted succinic anhydride is present in an amount of ≥95 wt.-% and preferably of ≥96.5 wt.-%, based on the total weight of the at least one mono-substituted succinic anhydride.

In one embodiment of the present invention, the at least one mono-substituted succinic anhydride is a mixture of two or more kinds of alkenyl mono-substituted succinic anhydrides. For example, the at least one mono-substituted succinic anhydride is a mixture of two or three kinds of alkenyl mono-substituted succinic anhydrides.

In one embodiment of the present invention, the at least one mono-substituted succinic anhydride is a mixture of two or more kinds of alkenyl mono-substituted succinic anhydrides comprising linear hexadecenyl succinic anhydride(s) and linear octadecenyl succinic anhydride(s). Alternatively, the at least one mono-substituted succinic anhydride is a mixture of two or more kinds of alkenyl mono-substituted succinic anhydrides comprising branched hexadecenyl succinic anhydride(s) and branched octadecenyl succinic anhydride(s). For example, the one or more hexadecenyl succinic anhydride is linear hexadecenyl succinic anhydride like n-hexadecenyl succinic anhydride and/or branched hexadecenyl succinic anhydride like 1-hexyl-2-decenyl succinic anhydride. Additionally or alternatively, the one or more octadecenyl succinic anhydride is linear octadecenyl succinic anhydride like n-octadecenyl succinic anhydride and/or branched octadecenyl succinic anhydride like iso-octadecenyl succinic anhydride and/or 1-octyl-2-decenyl succinic anhydride.

It is also appreciated that the at least one mono-substituted succinic anhydride may be a mixture of at least one alkyl mono-substituted succinic anhydrides and at least one alkenyl mono-substituted succinic anhydrides.

If the at least one mono-substituted succinic anhydride is a mixture of at least one alkyl mono-substituted succinic anhydrides and at least one alkenyl mono-substituted succinic anhydrides, it is appreciated that the alkyl substituent of the of at least one alkyl mono-substituted succinic anhydrides and the alkenyl substituent of the of at least one alkenyl mono-substituted succinic anhydrides are preferably the same. For example, the at least one mono-substituted succinic anhydride is a mixture of ethylsuccinic anhydride and ethenylsuccinic anhydride. Alternatively, the at least one mono-substituted succinic anhydride is a mixture of propylsuccinic anhydride and propenylsuccinic anhydride. Alternatively, the at least one mono-substituted succinic anhydride is a mixture of butylsuccinic anhydride and butenylsuccinic anhydride. Alternatively, the at least one mono-substituted succinic anhydride is a mixture of triisobutyl succinic anhydride and triisobutenyl succinic anhydride. Alternatively, the at least one mono-substituted succinic anhydride is a mixture of pentylsuccinic anhydride and pentenylsuccinic anhydride. Alternatively, the at least one mono-substituted succinic anhydride is a mixture of hexylsuccinic anhydride and hexenylsuccinic anhydride. Alternatively, the at least one mono-substituted succinic anhydride is a mixture of heptylsuccinic anhydride and heptenylsuccinic anhydride. Alternatively, the at least one mono-substituted succinic anhydride is a mixture of octyisuccinic anhydride and octenylsuccinic anhydride. Alternatively, the at least one mono-substituted succinic anhydride is a mixture of nonylsuccinic anhydride and nonenylsuccinic anhydride. Alternatively, the at least one mono-substituted succinic anhydride is a mixture of decyl succinic anhydride and decenyl succinic anhydride. Alternatively, the at least one mono-substituted succinic anhydride is a mixture of dodecyl succinic anhydride and dodecenyl succinic anhydride. Alternatively, the at least one mono-substituted succinic anhydride is a mixture of hexadecanyl succinic anhydride and hexadecenyl succinic anhydride. For example, the at least one mono-substituted succinic anhydride is a mixture of linear hexadecanyl succinic anhydride and linear hexadecenyl succinic anhydride or a mixture of branched hexadecanyl succinic anhydride and branched hexadecenyl succinic anhydride. Alternatively, the at least one mono-substituted succinic anhydride is a mixture of octadecanyl succinic anhydride and octadecenyl succinic anhydride. For example, the at least one mono-substituted succinic anhydride is a mixture of linear octadecanyl succinic anhydride and linear octadecenyl succinic anhydride or a mixture of branched octadecanyl succinic anhydride and branched octadecenyl succinic anhydride.

In one embodiment of the present invention, the at least one mono-substituted succinic anhydride is a mixture of nonylsuccinic anhydride and nonenylsuccinic anhydride.

If the at least one mono-substituted succinic anhydride is a mixture of at least one alkyl mono-substituted succinic anhydrides and at least one alkenyl mono-substituted succinic anhydrides, the weight ratio between the at least one alkyl mono-substituted succinic anhydride and the at least one alkenyl mono-substituted succinic anhydride is between 90:10 and 10:90 (wt.-%/wt.-%). For example, the weight ratio between the at least one alkyl mono-substituted succinic anhydride and the at least one alkenyl mono-substituted succinic anhydride is between 70:30 and 30:70 (wt.-%/wt.-%) or between 60:10 and 40:60.

Additionally or alternatively, the hydrophobising agent may be a phosphoric acid ester blend. Accordingly, at least a part of the accessible surface area of the calcium carbonate particles is covered by a treatment layer comprising a phosphoric acid ester blend of one or more phosphoric acid mono-ester and/or reaction products thereof and one or more phosphoric acid di-ester and/or reaction products thereof.

The term "reaction products" of the phosphoric acid mono-ester and one or more phosphoric acid di-ester in the meaning of the present invention refers to products obtained by contacting the calcium carbonate with the at least one phosphoric acid ester blend. Said reaction products are formed between at least a part of the applied phosphoric acid ester blend and reactive molecules located at the surface of the calcium carbonate particles.

The term "phosphoric acid mono-ester" in the meaning of the present invention refers to an o-phosphoric acid molecule mono-esterified with one alcohol molecule selected from unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

The term "phosphoric acid di-ester" in the meaning of the present invention refers to an o-phosphoric acid molecule di-esterified with two alcohol molecules selected from the same or different, unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

It is appreciated that the expression "one or more" phosphoric acid mono-ester means that one or more kinds of phosphoric acid mono-ester may be present in the phosphoric acid ester blend.

Accordingly, it should be noted that the one or more phosphoric acid mono-ester may be one kind of phosphoric acid mono-ester. Alternatively, the one or more phosphoric acid mono-ester may be a mixture of two or more kinds of phosphoric acid mono-ester. For example, the one or more phosphoric acid mono-ester may be a mixture of two or three kinds of phosphoric acid mono-ester, like two kinds of phosphoric acid mono-ester.

In one embodiment of the present invention, the one or more phosphoric acid mono-ester consists of an o-phosphoric acid molecule esterified with one alcohol selected from unsaturated or saturated, branched or linear, aliphatic or aromatic alcohols having a total amount of carbon atoms from C6 to C30 in the alcohol substituent. For example, the one or more phosphoric acid mono-ester consists of an o-phosphoric acid molecule esterified with one alcohol selected from unsaturated or saturated, branched or linear, aliphatic or aromatic alcohols having a total amount of carbon atoms from C8 to C22, more preferably from C8 to C20 and most preferably from C8 to C18 in the alcohol substituent.

In one embodiment of the present invention, the one or more phosphoric acid mono-ester is selected from the group comprising hexyl phosphoric acid mono-ester, heptyl phosphoric acid mono-ester, octyl phosphoric acid mono-ester, 2-ethylhexyl phosphoric acid mono-ester, nonyl phosphoric acid mono-ester, decyl phosphoric acid mono-ester, undecyl phosphoric acid mono-ester, dodecyl phosphoric acid mono-ester, tetradecyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof.

For example, the one or more phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof. In one embodiment of the present invention, the one or more phosphoric acid mono-ester is 2-octyl-1-dodecylphosphoric acid mono-ester.

It is appreciated that the expression "one or more" phosphoric acid di-ester means that one or more kinds of phosphoric acid di-ester may be present in the coating layer of the calcium carbonate and/or the phosphoric acid ester blend.

Accordingly, it should be noted that the one or more phosphoric acid di-ester may be one kind of phosphoric acid di-ester. Alternatively, the one or more phosphoric acid di-ester may be a mixture of two or more kinds of phosphoric acid di-ester. For example, the one or more phosphoric acid di-ester may be a mixture of two or three kinds of phosphoric acid di-ester, like two kinds of phosphoric acid di-ester.

In one embodiment of the present invention, the one or more phosphoric acid di-ester consists of an o-phosphoric acid molecule esterified with two alcohols selected from unsaturated or saturated, branched or linear, aliphatic or aromatic alcohols having a total amount of carbon atoms from C6 to C30 in the alcohol substituent. For example, the one or more phosphoric acid di-ester consists of an o-phosphoric acid molecule esterified with two fatty alcohols selected from unsaturated or saturated, branched or linear, aliphatic or aromatic alcohols having a total amount of carbon atoms from C8 to C22, more preferably from C8 to C20 and most preferably from C8 to C18 in the alcohol substituent.

It is appreciated that the two alcohols used for esterifying the phosphoric acid may be independently selected from the same or different, unsaturated or saturated, branched or linear, aliphatic or aromatic alcohols having a total amount of carbon atoms from C6 to C30 in the alcohol substituent. In other words, the one or more phosphoric acid di-ester may comprise two substituents being derived from the same alcohols or the phosphoric acid di-ester molecule may comprise two substituents being derived from different alcohols.

In one embodiment of the present invention, the one or more phosphoric acid di-ester consists of an o-phosphoric acid molecule esterified with two alcohols selected from the same or different, saturated and linear and aliphatic alcohols having a total amount of carbon atoms from C6 to C30, preferably from C8 to C22, more preferably from C8 to C20 and most preferably from C8 to C18 in the alcohol substituent. Alternatively, the one or more phosphoric acid di-ester consists of an o-phosphoric acid molecule esterified with two alcohols selected from the same or different, saturated and branched and aliphatic alcohols having a total amount of carbon atoms from C6 to C30, preferably from C8 to C22, more preferably from C8 to C20 and most preferably from C8 to C18 in the alcohol substituent.

In one embodiment of the present invention, the one or more phosphoric acid di-ester is selected from the group comprising hexyl phosphoric acid di-ester, heptyl phosphoric acid di-ester, octyl phosphoric acid di-ester, 2-ethylhexyl phosphoric acid di-ester, nonyl phosphoric acid di-ester, decyl phosphoric acid di-ester, undecyl phosphoric acid di-ester, dodecyl phosphoric acid di-ester, tetradecyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof.

For example, the one or more phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof. In one embodiment of the present invention, the one or more phosphoric acid di-ester is 2-octyl-1-dodecylphosphoric acid di-ester.

In one embodiment of the present invention, the one or more phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester, 2-octyl-1-dodecylphosphoric acid mono-ester and mixtures thereof and the one or more phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester, 2-octyl-1-dodecylphosphoric acid di-ester and mixtures thereof.

For example, at least a part of the accessible surface area of the calcium carbonate comprises a phosphoric acid ester blend of one phosphoric acid mono-ester and/or reaction products thereof and one phosphoric acid di-ester and/or reaction products thereof. In this case, the one phosphoric acid mono-ester is selected from the group comprising 2-ethylhexyl phosphoric acid mono-ester, hexadecyl phosphoric acid mono-ester, heptylnonyl phosphoric acid mono-ester, octadecyl phosphoric acid mono-ester, 2-octyl-1-decylphosphoric acid mono-ester and 2-octyl-1-dodecylphosphoric acid mono-ester, the one phosphoric acid di-ester is selected from the group comprising 2-ethylhexyl phosphoric acid di-ester, hexadecyl phosphoric acid di-ester, heptylnonyl phosphoric acid di-ester, octadecyl phosphoric acid di-ester, 2-octyl-1-decylphosphoric acid di-ester and 2-octyl-1-dodecylphosphoric acid di-ester.

The phosphoric acid ester blend comprises the one or more phosphoric acid mono-ester and/or reaction products thereof to the one or more phosphoric acid di-ester and/or reaction products thereof in a specific molar ratio. In particular, the molar ratio of the one or more phosphoric acid mono-ester and/or reaction products thereof to the one or more phosphoric acid di-ester and/or reaction products thereof in the treatment layer and/or the phosphoric acid ester blend is from 1:1 to 1:100, preferably from 1:1.1 to 1:60, more preferably from 1:1.1 to 1:40, even more preferably from 1:1.1 to 1:20 and most preferably from 1:1.1 to 1:10.

The wording "molar ratio of the one or more phosphoric acid mono-ester and reaction products thereof to the one or more phosphoric acid di-ester and reaction products thereof" in the meaning of the present invention refers to the sum of the molecular weight of the phosphoric acid mono-ester molecules and/or the sum of the molecular weight of the phosphoric acid mono-ester molecules in the reaction products thereof to the sum of the molecular weight of the phosphoric acid di-ester molecules and/or the sum of the molecular weight of the phosphoric acid di-ester molecules in the reaction products thereof.

In one embodiment of the present invention, the phosphoric acid ester blend coated on at least a part of the surface of the calcium carbonate may further comprise one or more phosphoric acid tri-ester and/or phosphoric acid and/or reaction products thereof.

The term "phosphoric acid tri-ester" in the meaning of the present invention refers to an o-phosphoric acid molecule tri-esterified with three alcohol molecules selected from the same or different, unsaturated or saturated, branched or linear, aliphatic or aromatic alcohols having a total amount of carbon atoms from C6 to C30, preferably from C8 to C22, more preferably from C8 to C20 and most preferably from C8 to C18 in the alcohol substituent.

It is appreciated that the expression "one or more" phosphoric acid tri-ester means that one or more kinds of phosphoric acid tri-ester may be present on at least a part of the accessible surface area of the calcium carbonate.

Accordingly, it should be noted that the one or more phosphoric acid tri-ester may be one kind of phosphoric acid tri-ester. Alternatively, the one or more phosphoric acid tri-ester may be a mixture of two or more kinds of phosphoric acid tri-ester. For example, the one or more phosphoric acid tri-ester may be a mixture of two or three kinds of phosphoric acid tri-ester, like two kinds of phosphoric acid tri-ester.

According to a preferred embodiment of the present invention, in method step a) a substrate is provided, wherein the substrate comprises on at least one side a coating layer comprising calcium carbonate, preferably ground calcium carbonate, precipitated calcium carbonate and/or surface-treated calcium carbonate.

According to one embodiment, the salifiable alkaline or alkaline earth compound is in form of particles having a weight median particle size $d_{50}$ from 15 nm to 200 μm, preferably from 20 nm to 100 μm, more preferably from 50 nm to 50 μm, and most preferably from 100 nm to 2 μm.

According to one embodiment, the salifiable alkaline or alkaline earth compound has a specific surface area (BET) from 4 to 120 $m^2/g$, preferably from 8 to 50 $m^2/g$, as measured using nitrogen and the BET method according to ISO 9277.

The amount of the salifiable alkaline or alkaline earth compound in the coating layer can range from 40 to 99 wt.-%, based on the total weight of the coating layer, preferably from 45 to 98 wt.-%, and more preferably from 60 to 97 wt.-%.

According to one embodiment, the coating layer further comprises a binder, preferably in an amount from 1 to 50 wt.-%, based on the total weight of the salifiable alkaline or alkaline earth compound, preferably from 3 to 30 wt.-%, and more preferably from 5 to 15 wt.-%.

Any suitable polymeric binder may be used in the liquid coating composition of the invention. For example, the polymeric binder may be a hydrophilic polymer such as, for example, polyvinyl alcohol, polyvinyl pyrrolidone, gelatin, cellulose ethers, polyoxazolines, polyvinylacetamides, partially hydrolyzed polyvinyl acetate/vinyl alcohol, polyacrylic acid, polyacrylamide, polyalkylene oxide, sulfonated or phosphated polyesters and polystyrenes, casein, zein, albumin, chitin, chitosan, dextran, pectin, collagen derivatives, collodian, agaragar, arrowroot, guar, carrageenan, starch, tragacanth, xanthan, or rhamsan and mixtures thereof. It is also possible to use other binders such as hydrophobic materials, for example, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like and mixtures thereof. Further examples of suitable binders are homopolymers or copolymers of acrylic and/or methacrylic acids, itaconic acid, and acid esters, such as e.g. ethylacrylate, butyl acrylate, styrene, unsubstituted or substituted vinyl chloride, vinyl acetate, ethylene, butadiene, acrylamides and acrylonitriles, silicone resins, water dilutable alkyd resins, acrylic/alkyd resin combinations, natural oils such as linseed oil, and mixtures thereof.

According to one embodiment, the binder is selected from starch, polyvinylalcohol, styrene-butadiene latex, styrene-acrylate, polyvinyl acetate latex, polyolefines, ethylene acrylate, microfibrillated cellulose, microcrystalline cellulose, nanocellulose, cellulose, carboxymethylcellulose, bio-based latex, or mixtures thereof.

According to another embodiment, the coating layer does not comprise a binder.

Other optional additives that may be present in the coating layer are, for example, dispersants, milling aids, surfactants, rheology modifiers, lubricants, defoamers, optical brighteners, dyes, preservatives, or pH controlling agents. According to one embodiment, the coating layer further comprises a rheology modifier. Preferably the rheology modifier is present in an amount of less than 1 wt.-%, based on the total weight of the filler.

According to an exemplary embodiment, the salifiable alkaline or alkaline earth compound is dispersed with a dispersant. The dispersant may be used in an amount from 0.01 to 10 wt.-%, 0.05 to 8 wt.-%, 0.5 to 5 wt.-%, 0.8 to 3 wt.-%, or 1.0 to 1.5 wt.-%, based on the total weight of the salifiable alkaline or alkaline earth compound. In a preferred embodiment, the salifiable alkaline or alkaline earth compound is dispersed with an amount of 0.05 to 5 wt.-%, and preferably with an amount of 0.5 to 5 wt.-% of a dispersant, based on the total weight of the salifiable alkaline or alkaline earth compound. A suitable dispersant is preferably selected from the group comprising homopolymers or copolymers of polycarboxylic acid salts based on, for example, acrylic acid, methacrylic acid, maleic acid, fumaric acid or itaconic acid and acrylamide or mixtures thereof. Homopolymers or copolymers of acrylic acid are especially preferred. The molecular weight $M_w$ of such products is preferably in the range of 2000 to 15000 g/mol, with a molecular weight $M_w$ of 3000 to 7000 g/mol being especially preferred. The molecular weight $M_w$ of such products is also preferably in the range of 2000 to 150000 g/mol, and an $M_w$ of 15000 to 50000 g/mol is especially preferred, e.g., 35000 to 45000 g/mol. According to an exemplary embodiment, the dispersant is polyacrylate.

The coating layer may also comprise active agents, for example, bioactive molecules as additives, for example, enzymes, chromatic indicators susceptible to change in pH or temperature, or fluorescent materials.

According to one embodiment, the coating layer has a coat weight from 0.5 to 100 g/m$^2$, preferably from 1 to 75 g/m$^2$, more preferably from 2 to 50 g/m$^2$, and most preferably from 4 to 25 g/m$^2$.

The coating layer may have a thickness of at least 1 μm, e.g. at least 5 μm, 10 μm, 15 μm or 20 μm. Preferably the coating layer has a thickness in the range of 1 μm up to 150 μmm.

According to one embodiment, the substrate comprises a first side and a reverse side, and the substrate comprises a coating layer comprising a salifiable alkaline or alkaline earth compound on the first side and the reverse side. According to a preferred embodiment, the substrate comprises a first side and a reverse side, and the substrate comprises a coating layer comprising an alkaline or alkaline earth carbonate, preferably calcium carbonate, on the first side and the reverse side.

According to one embodiment, the coating layer is in direct contact with the surface of the substrate.

According to a further embodiment, the substrate comprises one or more additional precoating layers between the substrate and the coating layer comprising a salifiable alkaline or alkaline earth compound. Such additional precoating layers may comprise kaolin, silica, talc, plastic, precipitated calcium carbonate, modified calcium carbonate, ground calcium carbonate, or mixtures thereof. In this case, the coating layer may be in direct contact with the precoating layer, or, if more than one precoating layer is present, the coating layer may be in direct contact with the top precoating layer.

According to another embodiment of the present invention, the substrate comprises one or more barrier layers between the substrate and the coating layer comprising a salifiable alkaline or alkaline earth compound. In this case, the coating layer may be in direct contact with the barrier layer, or, if more than one barrier layer is present, the coating layer may be in direct contact with the top barrier layer. The barrier layer may comprise a polymer, for example, polyvinyl alcohol, polyvinyl pyrrolidone, gelatin, cellulose ethers, polyoxazolines, polyvinylacetamides, partially hydrolyzed polyvinyl acetate/vinyl alcohol, polyacrylic acid, polyacrylamide, polyalkylene oxide, sulfonated or phosphated polyesters and polystyrenes, casein, zein, albumin, chitin, chitosan, dextran, pectin, collagen derivatives, collodian, agaragar, arrowroot, guar, carrageenan, starch, tragacanth, xanthan, rhamsan, poly(styrene-co-butadiene), polyurethane latex, polyester latex, poly(n-butyl acrylate), poly(n-butyl methacrylate), poly(2-ethylhexyl acrylate), copolymers of n-butylacrylate and ethylacrylate, copolymers of vinylacetate and n-butylacrylate, and the like and mixtures thereof. Further examples of suitable barrier layers are homopolymers or copolymers of acrylic and/or methacrylic acids, itaconic acid, and acid esters, such as e.g. ethylacrylate, butyl acrylate, styrene, unsubstituted or substituted vinyl chloride, vinyl acetate, ethylene, butadiene, acrylamides and acrylonitriles, silicone resins, water dilatable alkyd resins, acrylic/alkyd resin combinations, natural oils such as linseed oil, and mixtures thereof. According to one embodiment, the barrier layer comprises latexes, polyolefins, polyvinylalcohols, kaolin, talcum, mica for creating tortuous structures (stacked structures), and mixtures thereof.

According to still another embodiment of the present invention, the substrate comprises one or more precoating and barrier layers between the substrate and the coating layer comprising a salifiable alkaline or alkaline earth compound. In this case, the coating layer may be in direct contact with the top precoating layer or barrier layer, respectively.

According to one embodiment of the present invention, the substrate of step a) is prepared by i) providing a substrate, ii) applying a coating composition comprising a salifiable alkaline or alkaline earth compound on at least one side of the substrate to form a coating layer, and iii) optionally, drying the coating layer.

The coating composition can be in liquid or dry form. According to one embodiment, the coating composition is a dry coating composition. According to another embodiment, the coating composition is a liquid coating composition. In this case, the coating layer may be dried.

According to one embodiment of the present invention, the coating composition is an aqueous composition, i.e. a composition containing water as the only solvent. According to another embodiment, the coating composition is a non-aqueous composition. Suitable solvents are known to the skilled person and are, for example, aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water.

According to one embodiment of the present invention, the solids content of the coating composition is in the range from 5 wt.-% to 75 wt.-%, preferably from 20 to 67 wt.-%, more preferably from 30 to 65 wt.-%, and most preferably from 50 to 62 wt.-%, based on the total weight of the composition. According to a preferred embodiment, the coating composition is an aqueous composition having a solids content in the range from 5 wt.-% to 75 wt.-%, preferably from 20 to 67 wt.-%, more preferably from 30 to 65 wt.-%, and most preferably from 50 to 62 wt.-%, based on the total weight of the composition.

According to one embodiment of the present invention, the coating composition has a Brookfield viscosity of between 10 and 4000 mPa·s at 20° C., preferably between 100 and 3500 mPa·s at 20° C., more preferably between 200 and 3000 mPa·s at 20° C., and most preferably between 250 and 2000 mPa·s at 20° C.

According to one embodiment, method steps ii) and iii) are also carried out on the reverse side of the substrate to manufacture a substrate being coated on the first and the reverse side. These steps may be carried out for each side separately or may be carried out on the first and the reverse side simultaneously.

According to one embodiment of the present invention, method steps ii) and iii) are carried out two or more times using a different or the same coating composition.

According to one embodiment of the present invention, one or more additional coating compositions are applied onto at least one side of the substrate before method step ii). The additional coating compositions may be precoating compositions and/or a barrier layer compositions.

The coating compositions may be applied onto the substrate by conventional coating means commonly used in this art. Suitable coating methods are, e.g., air knife coating, electrostatic coating, metering size press, film coating, spray coating, wound wire rod coating, slot coating, slide hopper coating, gravure, curtain coating, high speed coating and the like. Some of these methods allow for simultaneous coatings of two or more layers, which is preferred from a manufacturing economic perspective. However, any other coating method which would be suitable to form a coating layer on the substrate may also be used.

According to an exemplary embodiment, the coating composition is applied by high speed coating, metering size press, curtain coating, spray coating, flexo and gravure, or blade coating, preferably curtain coating.

According to step iii), the coating layer formed on the substrate is dried. The drying can be carried out by any method known in the art, and the skilled person will adapt the drying conditions such as the temperature according to his process equipment. For example, the coating layer can be dried by infrared drying and/or convection drying. The drying step may be carried out at room temperature, i.e. at a temperature of 20° C.±2° C. or at other temperatures. According to one embodiment, method step is carried out at substrate surface temperature from 25 to 150° C., preferably from 50 to 140° C., and more preferably from 75 to 130° C. Optionally applied precoating layers and/or barrier layers can be dried in the same way.

After coating, the coated substrate may be subject to calendering or super-calendering to enhance surface smoothness. For example, calendering may be carried out at a temperature from 20 to 200° C., preferably from 60 to 100° C. using, for example, a calender having 2 to 12 nips. Said nips may be hard or soft, hard nips, for example, can be made of a ceramic material. According to one exemplary embodiment, the coated substrate is calendered at 300 kN/m to obtain a glossy coating. According to another exemplary embodiment, the coated substrate is calendered at 120 kN/m to obtain a matt coating.

Method Steps b) and c)

According to step b) of the method of the present invention, a liquid treatment composition comprising an acid is provided.

The liquid treatment composition may comprise any inorganic or organic acid that forms $CO_2$ when it reacts with a salifiable alkaline or alkaline earth compound. According to one embodiment, the acid is an organic acid, preferably a monocarboxylic, dicarboxylic or tricarboxylic acid.

According to one embodiment, the acid is a strong acid having a $pK_a$ of 0 or less at 20° C. According to another embodiment, the acid is a medium-strong acid having a $pK_a$ value from 0 to 2.5 at 20° C., if the $pK_a$ at 20° C. is 0 or less, the acid is preferably selected from sulphuric acid, hydrochloric acid, or mixtures thereof. If the $pK_a$ at 20° C. is from 0 to 2.5, the acid is preferably selected from $H_2SO_3$, $H_3PO_4$, oxalic acid, or mixtures thereof. However, acids having a $pK_a$ of more than 2.5 may also be used, for example, suberic acid, succinic acid, acetic acid, citric acid, formic acid, sulphamic acid, tartaric acid, benzoic acid, or phytic acid.

According to one embodiment of the present invention, the acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, and mixtures thereof. According to a preferred embodiment, the acid is selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, more preferably the acid is selected from the group consisting of sulphuric acid, phosphoric acid, boric acid, suberic acid, sulphamic acid, tartaric acid, and mixtures thereof, and most preferably the acid is phosphoric acid and/or sulphuric acid.

Acidic organosulfur compounds may be selected from sulfonic acids such as Nafion, p-toluenesulfonic acid, methanesulfonic acid, thiocarboxylic acids, sulfinic acids and/or sulfenic acids. Examples for acidic organophosphorus compounds are aminomethylphosphonic acid, 1-hydroxyethylidene-1,1-diphosphonic acid (HEDP), amino tris(methylenephosphonic acid) (ATMP), ethylenediamine tetra (methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), phosphonobutane-tricarboxylic acid (PBTC), N-(phosphonomethyl)iminodiacetic acid (PMIDA), 2-carboxyethyl phosphonic acid (CEPA), 2-hydroxyphosphonocarboxylic acid (HPAA), amino-tris-(methylene-phosphonic acid) (AMP), or di-(2-ethylhexyl) phosphoric acid.

The acid may consist of only one type of acid. Alternatively, the acid can consists of two or more types of acids.

The acid may be applied in concentrated form or in diluted form. According to one embodiment of the present invention, the liquid treatment composition comprises an acid and water. According to another embodiment of the present invention, the liquid treatment composition comprises an acid and a solvent. According to another embodiment of the present invention, the liquid treatment composition comprises an acid, water, and a solvent. Suitable solvents are known in the art and are, for example, aliphatic alcohols, ethers and diethers having from 4 to 14 carbon atoms, glycols, alkoxylated glycols, glycol ethers, alkoxylated aromatic alcohols, aromatic alcohols, mixtures thereof, or mixtures thereof with water. According to one exemplary embodiment, the liquid coating composition comprises phosphoric acid, water, and ethanol, preferably in a weight ratio of 1:1:1.

According to a preferred embodiment the liquid treatment composition contains 41 wt.-% phosphoric acid, 23 wt.-% ethanol, and 36 wt.-% water, based on the total weight of the liquid treatment composition.

According to one embodiment, the liquid treatment composition comprises the acid in an amount from 0.1 to 100 wt.-%, based on the total weight of the liquid treatment composition, preferably in an amount from 1 to 80 wt.-%, more preferably in an amount from 2 to 50 wt.-%, and most preferably in an amount from 5 to 30 wt.-%.

According to step c) of the method of the present invention an ink is provided.

The ink can be any ink that is suitable for inkjet printing. For example, the ink is a liquid composition comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inkjet inks based on oil as carrier can also be used. It is also possible to use fluorescent or phosphorescent inks or inks which absorb ultraviolet light or near infrared light.

According to one embodiment the ink comprises a natural pigment, a synthetic pigment, a natural organic dye, a water-soluble synthetic dye, a wax dye, a solvent-soluble dye, an alcohol soluble dye, or a mixture thereof.

According to one embodiment, the ink comprises at least one dye and/or at least one pigment in an amount from 0.001 to 15 wt.-%, preferably from 0.01 to 10 wt.-%, and most preferably from 0.1 to 8 wt.-%, based on the total weight of the ink.

The liquid treatment composition of step b) and the ink of step c) can be provided separately or in combination.

According to one embodiment of the present invention, the liquid treatment composition of step b) and the ink of step c) are provided separately. According to another embodiment of the present invention, the liquid treatment composition of step b) and the ink of step c) are provided together in form of an inkjet formulation.

According to a further aspect of the present invention, an inkjet formulation for use in the inkjet printing method of the present invention is provided, wherein the inkjet formulation comprises an acid and an ink. In addition, the inkjet formulation may comprise additives such as humectants, organic solvents, detergents, dispersants, thickeners, preservatives, and the like.

According to one embodiment, the inkjet formulation comprises an acid and a natural pigment, a synthetic pigment, a natural organic dye, a water-soluble synthetic dye, a wax dye, a solvent-soluble dye, an alcohol soluble dye, or a mixture thereof. According to another embodiment, the inkjet formulation comprises an acid selected from the group consisting of hydrochloric acid, sulphuric acid, sulphurous acid, phosphoric acid, oxalic acid, boric acid, suberic acid, succinic acid, sulphamic acid, tartaric acid, and mixtures thereof, preferably phosphoric acid, and a natural pigment, a synthetic pigment, a natural organic dye, a water-soluble synthetic dye, a wax dye, a solvent-soluble dye, an alcohol soluble dye, or a mixture thereof.

According to one embodiment, the inkjet formulation comprises the acid in an amount from 0.1 to 100 wt.-%, based on the total weight of the inkjet formulation, preferably in an amount from 1 to 80 wt.-%, more preferably in an amount from 2 to 50 wt.-%, and most preferably in an amount from 5 to 30 wt.-%, and the ink in an amount from 0.001 to 15 wt.-%, preferably from 0.01 to 10 wt.-%, and most preferably from 0.1 to 8 wt.-%, based on the total weight of the inkjet formulation.

Method Steps d) and e)

According to step d) of the method of the present invention, the liquid treatment composition is deposited onto the coating layer by inkjet printing to form a first pattern, and according to step e) of the method of the present invention, the ink is deposited onto the coating layer by inkjet printing to form a second pattern. It is a requirement of the inventive method that the liquid treatment composition and the ink are deposited simultaneously or consecutively and the first pattern and the second pattern overlap at least partially.

The liquid treatment composition and the ink can be deposited onto the coating layer by any suitable inkjet printing technique known in the art. According to one embodiment, the liquid treatment composition and the ink are deposited by continuous inkjet printing, intermittent inkjet printing and/or drop-on-demand inkjet printing.

The deposition of the liquid treatment composition and/or the ink onto the coating layer can be carried out at a surface temperature of the substrate, which is at room temperature, i.e. at a temperature of 20±2° C., or at an elevated temperature, for example, at about 60° C. Carrying out method step d) and/or method step e) at an elevated temperature may enhance the drying of the liquid treatment composition and/or the ink, and, hence, may reduce production time. According to one embodiment, method step d) and/or method step e) is carried out at a substrate surface temperature of more than 5° C., preferably more than 10° C., more preferably more than 15° C., and most preferably more than 20° C. According to one embodiment, method step d) and/or method step e) is carried out at a substrate surface temperature which is in the range from 5 to 120° C., more preferably in the range from 10 to 100° C., more preferably in the range from 15 to 80° C., and most preferably in the range from 20 to 60° C.

According to one embodiment, methods step d) and e) comprise depositing the liquid treatment composition and the ink from at least one ink reservoir, through a print head, and onto the coating layer. Preferably the temperature of the ink reservoir and/or print head is more than 5° C., preferably between 10° C. and 100° C., more preferably between 15° C. and 80° C., and most preferably between 20° C. and 60° C.

According to one embodiment of the present invention, the liquid treatment composition and the ink are deposited consecutively onto the coating layer. Thus, the liquid treatment composition and the ink are provided separately. The liquid treatment composition and/or the ink may be deposited consecutively onto the coating layer in at least one step. According to one embodiment, the liquid treatment composition and/or the ink are deposited in one step. According to another embodiment, the liquid treatment composition and/or the ink are deposited in two or more steps.

According to another embodiment of the present invention the liquid treatment composition and the ink are deposited simultaneously onto the coating layer. Thus, the liquid treatment composition and the ink are provided together in form of an inkjet formulation. The inkjet formulation may be deposited onto the coating layer in at least one step. According to one embodiment, the inkjet formulation is deposited in one step. According to another embodiment, the inkjet formulation is deposited in two or more steps.

According to one embodiment the liquid treatment composition and/or the ink or the inkjet formulation is deposited in form of drops having a volume of less than or equal to 1000 pl. According to one embodiment, the drops have a volume from 500 pl to 1 fl, preferably from 100 pl to 10 fl, more preferably from 50 pl to 100 fl, and most preferably from 10 pl to 1 pl. According to another embodiment, the drops have a volume of less than 1000 pl, preferably less than 600 pl, more preferably less than 200 pl, even more preferably less than 80 pl, and most preferably less than 20 pl. According to still another embodiment, the drops have a volume of less than 1 pl, preferably less than 500 fl, more preferably less than 200 fl, even more preferably less than 80 fl, and most preferably less than 20 fl.

In case the liquid treatment composition and the ink are deposited consecutively onto the coating layer, the drop volume of the liquid treatment composition and the ink can be the same or can be different. According to one embodiment, the liquid treatment composition and the ink are deposited consecutively in form of drops, wherein the drops of the liquid treatment composition and the ink have a different volume. According to another embodiment, the liquid treatment composition and the ink are deposited consecutively in form of drops, wherein the drops of the liquid treatment composition and the ink have the same volume.

According to one embodiment the liquid treatment composition and/or the ink or the inkjet formulation is deposited with a drop spacing of less than or equal to 1000 μm. According to one embodiment the drop spacing is from 10 nm to 500 μm, preferably from 100 nm to 300 μm, more preferably from 1 μm to 200 μm, and most preferably from 5 μm to 100 μm. According to another embodiment, the drop spacing is less 800 μm, more preferably less than 600 μm, even more preferably less than 400 μm, and most preferably less than 80 μm. According to still another embodiment, the drop spacing is less 500 nm, more preferably less than 300 nm, even more preferably less than 200 nm, and most preferably less than 80 nm. The drop spacing can also be zero, which means that the drops perfectly overlap.

In case the liquid treatment composition and the ink are deposited consecutively onto the coating layer, the drop spacing of the liquid treatment composition and the ink can be the same or can be different. According to one embodiment, the liquid treatment composition and the ink are deposited consecutively in form of drops, wherein the drop spacing of the liquid treatment composition and the ink is different. According to another embodiment, the liquid treatment composition and the ink are deposited consecutively in form of drops, wherein the drop spacing of the liquid treatment composition and the ink are the same.

The skilled person will appreciate that by controlling the drop volume, the drop diameter can be controlled, and thus, the diameter of the area which is treated with the liquid treatment composition and/or the ink or the inkjet formulation. The distance between two successive drops is determined by the drop spacing. Therefore, by varying the drop volume and the drop spacing the resolution of the first pattern and the second pattern can be adjusted.

According to one embodiment the first pattern and/or the second pattern is formed with a resolution of at least 150 dpi in the x and y directions, preferably at least 300 dpi in the x and y direction, more preferably at least 600 dpi in the x and y direction, even more preferably at least 1200 dpi, and most preferably at least 2400 dpi in the x and y direction or at least 4800 dpi in the x and y direction.

In case the liquid treatment composition and the ink are deposited consecutively onto the coating layer, the resolution of the first pattern and the second pattern can be the same or can be different. According to one embodiment, the resolution of the first pattern differs from the resolution of the second pattern. According to another embodiment, the resolution of the first pattern is the same as the resolution of the second pattern.

It is a requirement of the method of the present invention that the first pattern and the second pattern overlap at least partially. According to a preferred embodiment, the second pattern is completely located within the first pattern.

According to one embodiment of the present invention, the first pattern and the second pattern overlap by at least 50%, preferably at least 75%, more preferably at least 90%, even more preferably at least 95%, and most preferably at least 99%.

In case the liquid treatment composition and the ink are deposited consecutively, the first pattern and the second pattern may differ in shape. For example, the first pattern can be a filled area such as a square or rectangle and the second pattern can be a two-dimensional bar code or a text. According to another exemplary embodiment, the first pattern has the same shape as the second pattern, but is oversized to allow some deviation which may occur during the inkjet print of the second pattern.

In case the liquid treatment composition and the ink are deposited together in form of an inkjet formulation, the first pattern and the second pattern will be the same, and thus, they overlap by 100%.

According to one embodiment of the present invention the method for manufacturing an inkjet-printed substrate comprises the following steps:

a) providing a substrate, wherein the substrate comprises on at least one side a coating layer comprising a salifiable alkaline or alkaline earth compound,
b) providing a liquid treatment composition comprising an acid,
c) providing an ink,
d) depositing the liquid treatment composition onto the coating layer by inkjet printing to form a first pattern, and
e) depositing the ink onto the coating layer by inkjet printing to form a second pattern, wherein the liquid treatment composition and the ink are deposited consecutively and the first pattern and the second pattern overlap at least partially, and preferably the second pattern is completely located within the first pattern.

According to another embodiment of the present invention, the method for manufacturing an inkjet-printed substrate comprises the following steps:

a) providing a substrate, wherein the substrate comprises on at least one side a coating layer comprising a salifiable alkaline or alkaline earth compound,
b) providing an inkjet formulation comprising a liquid treatment composition comprising an acid and an ink, and
c) depositing the inkjet formulation onto the coating layer by inkjet printing to form a pattern.

According to one embodiment, the method for manufacturing an inkjet-printed substrate comprises the following steps:

a) providing a substrate, wherein the substrate comprises on at least one side a coating layer comprising a salifiable alkaline or alkaline earth compound selected from the group consisting of lithium carbonate, sodium carbonate, potassium carbonate, magnesium carbonate calcium magnesium carbonate, calcium carbonate, and mixtures thereof, preferably calcium carbonate,
b) providing a liquid treatment composition comprising an acid selected from the group consisting of hydrochloric acid, sulphuric acid, sulphurous acid, phosphoric acid, oxalic acid, boric acid, suberic acid, succinic acid, sulphamic acid, tartaric acid, and mixtures thereof,
c) providing an ink,
d) depositing the liquid treatment composition onto the coating layer by inkjet printing to form a first pattern, and
e) depositing the ink onto the coating layer by inkjet printing to form a second pattern, wherein the liquid treatment composition and the ink are deposited simultaneously or consecutively, the first pattern and the second pattern overlap at least partially, and the second pattern is completely located within the first pattern.

According to the method of the present invention, the first pattern and/or the second pattern is an one-dimensional bar code, a two-dimensional bar code, a three-dimensional bar code, a security mark, a number, a letter, an alphanumeric symbol, a logo, an image, a shape or a design. The first pattern and/or the second pattern may have a resolution of more than 150 dpi, preferably more than 300 dpi, more preferably more than 600 dpi, even more preferably more than 1200 dpi, and most preferably more than 2400 dpi or more than 4800 dpi.

Without being bound to any theory, it is believed that by the application of the liquid treatment composition onto the coating layer, the salifiable alkaline or alkaline earth compound of the coating layer reacts with the at least one acid included in the treatment composition. Thereby the salifiable alkaline or alkaline earth compound is at least partially converted into an acid salt, which may have different properties compared to the original material. In case the salifiable alkaline or alkaline earth compound is an alkaline or alkaline earth carbonate, for example, the compound would be converted by the acid treatment into a non-carbonate alkaline or alkaline earth salt.

The inventors surprisingly found that by depositing a liquid treatment composition comprising an acid separately or in form of an inkjet formulation onto the coating layer a pattern can be formed, which may allow better local absorption of the inkjet ink. This may lead to a sharper image and may reduce drying time of the ink, which may provide the possibility of creating high resolution patterns on substrates that are less suitable for inkjet printing such as substrates for offset printing or flexography.

Moreover, the method of the present invention has the advantage that it can be carried out with conventional inkjet printers just by adding a further inkjet printhead or cartridge including the liquid treatment composition or by replacing the conventional ink by the inkjet formulation of the present invention. Thus, the method of the present invention can be implemented in existing print facilities and does not require cost-intensive and time-consuming modifications of such printing lines. Furthermore, due to the reduced ink drying time, the inventive method may reduce energy costs and allow faster printing speeds.

By depositing the liquid treatment composition onto the coating layer, the salifiable alkaline or alkaline earth compound can be converted into a water-insoluble or water-soluble salt.

According to one embodiment, the first pattern comprises an acid salt of the salifiable alkaline or alkaline earth compound. According to another embodiment, the first pattern comprises a non-carbonate alkaline or alkaline earth salt, preferably an insoluble non-carbonate alkaline or alkaline earth salt. According to a preferred embodiment, the first pattern comprises a non-carbonate calcium salt, preferably an insoluble non-carbonate calcium salt. In the meaning of the present invention "water-insoluble" materials are defined as materials which, when mixed with deionised water and filtered on a filter having a 0.2 μm pore size at 20° C. to recover the liquid filtrate, provide less than or equal to 0.1 g of recovered solid material following evaporation at 95 to 100° C. of 100 g of said liquid filtrate. "Water-soluble" materials are defined as materials leading to the recovery of greater than 0.1 g of recovered solid material following evaporation at 95 to 100° C. of 100 g of said liquid filtrate.

According to one embodiment, the first pattern has an increased hydrophilicity compared to the remaining non-treated regions of the coating layer and/or has an increased porosity compared to the remaining non-treated regions of the coating layer and/or has an increased specific surface area compared to the remaining non-treated regions of the coating layer and/or has an increased roughness compared to the remaining non-treated regions of the coating layer and/or has a decreased gloss compared to the remaining non-treated regions of the coating layer.

For example, the hydrophilic or hydrophobic nature of the first pattern and the remaining non-treated regions of the coating layer can be quantified by applying a drop of water on the respective region and measuring the contact angle θ between the solid surface and the edge surface of the water drop. When $\theta<90°$, the solid surface is hydrophilic and water is said to wet the surface, wherein in case $\theta=1$, water completely wets the surface. When $\theta>90°$, the solid surface is hydrophobic and no wetting takes place unless an external force is applied.

According to one embodiment of the present invention, the first pattern has a contact angle from 0° to 110°, preferably from 5° to 90°, and more preferably from 10° to 80°.

Additional Process Steps

According to one embodiment of the invention, the method further comprises a step f) of applying a protective layer above the first pattern and the second pattern.

The protective layer can be made from any material, which is suitable to protect the underlying patterns against unwanted environmental impacts or mechanical wear. Examples for suitable materials are resins, varnishes, silicons, polymers, metal foils, or cellulose-based materials.

The protective layer may be applied above the first pattern and the second pattern by any method known in the art and suitable for the material of the protective layer. Suitable methods are, for example, air knife coating, electrostatic coating, metering size press, film coating, spray coating, extrusion coating, wound wire rod coating, slot coating, slide hopper coating, gravure, curtain coating, high speed coating, lamination, printing, adhesive bonding, and the like.

According to one embodiment of the present invention, the protective layer is applied above the first pattern, the second pattern and the remaining coating layer.

According to one embodiment, the protective layer is a removable protective layer. According to a further embodiment of the present invention, the substrate provided in step a) comprises on the first side and on the reverse side a coating layer comprising a salifiable alkaline or alkaline earth compound, and in step d) the liquid treatment composition comprising an acid is deposited onto the coating layer on the first and the reverse side to form a first pattern on the coating layer of the first and the reverse side. Step d) may be carried out for each side separately or may be carried out on the first and the reverse side simultaneously. In addition, in step e) the ink may deposited on the coating layer on the first and the reverse side to form a second pattern on the coating layer of the first and the reverse side. Step e) may be carried out for each side separately or may be carried out on the first and the reverse side simultaneously.

According to one embodiment of the present invention, method step d) is carried out two or more times using a different or the same liquid treatment composition. According to another embodiment of the present invention, method step e) is carried out two or more times using a different or the same ink.

According to one embodiment, the method for manufacturing an inkjet-printed substrate comprises the following steps:

a) providing a substrate, wherein the substrate comprises on at least one side a coating layer comprising a salifiable alkaline or alkaline earth compound,
b) providing a liquid treatment composition comprising an acid,
c) providing at least one ink,
d) depositing the liquid treatment composition onto the coating layer by inkjet printing to form a first pattern, and
e) depositing the at least one ink onto the coating layer by inkjet printing to form at least one further pattern, wherein the liquid treatment composition and the ink are deposited simultaneously or consecutively and the first pattern and the at least one further pattern overlap at least partially.

According to one embodiment, method step c) comprises providing two inks and method step e) comprises depositing the two inks onto the coating layer by inkjet printing to form a second pattern and a third pattern. According to another embodiment, method step c) comprises providing three inks and method step e) comprises depositing the three inks onto the coating layer by inkjet printing to form a second pattern, a third pattern, and a fourth pattern.

The Inkjet-Printed Substrate

According to one aspect of the present invention, an inkjet-printed substrate obtainable by the method according to the present invention is provided.

According to one embodiment, an inkjet-printed substrate is provided, wherein the substrate comprises on at least one side a coating layer comprising a salifiable alkaline or alkaline earth compound, and wherein the coating layer comprises a first pattern comprising an acid salt of the salifiable alkaline or alkaline earth compound, and a second pattern comprising an ink, wherein the first pattern and the second pattern overlap at least partially. Preferably, the salifiable alkaline or alkaline earth compound is an alkaline or alkaline earth carbonate, preferably a calcium carbonate, and the first pattern comprises a non-carbonate alkaline or alkaline earth salt, preferably a non-carbonate calcium salt. According to a preferred embodiment, the second pattern is completely located within the first pattern.

The inkjet-printed substrate obtained by the method of the present invention may be employed in any application or product, and especially, in applications or products which require high quality inkjet prints. According to one embodiment of the present invention, the inkjet-printed substrate is used in packaging applications, in decorative applications, in artistic applications, or in visual applications. According to one embodiment, the inkjet-printed substrate is used as wall paper, packaging, gift wrap paper, advertisement paper or poster, business card, manual, warranty sheet or card. The inkjet-printed substrate can also be used in commercials or as artificial wood or stone panel, where the pattern is made by printing, e.g. in construction materials.

According to a further aspect of the present invention, an inkjet formulation for use in the method according to the present invention is provided, comprising a liquid treatment composition comprising an acid and an ink.

According to still a further aspect of the present invention, a method for manufacturing a substrate with improved inkjet-printability is provided comprising the following steps:

A) providing a substrate, wherein the substrate comprises on at least one side a coating layer comprising a salifiable alkaline or alkaline earth compound, B) providing a liquid treatment composition comprising an acid, and C) depositing the liquid treatment composition onto the coating layer by inkjet printing to form a pattern with improved inkjet printability.

According to still a further aspect, a substrate with improved inkjet-printability obtainable by the above-mentioned method is provided. According to one embodiment, said substrate with improved inkjet-printability is used in inkjet printing applications.

The scope and interest of the present invention will be better understood based on the following figures and examples which are intended to illustrate certain embodiments of the present invention and are non-limitative.

EXAMPLES

1. Optical Microscope Pictures

Figure 1:
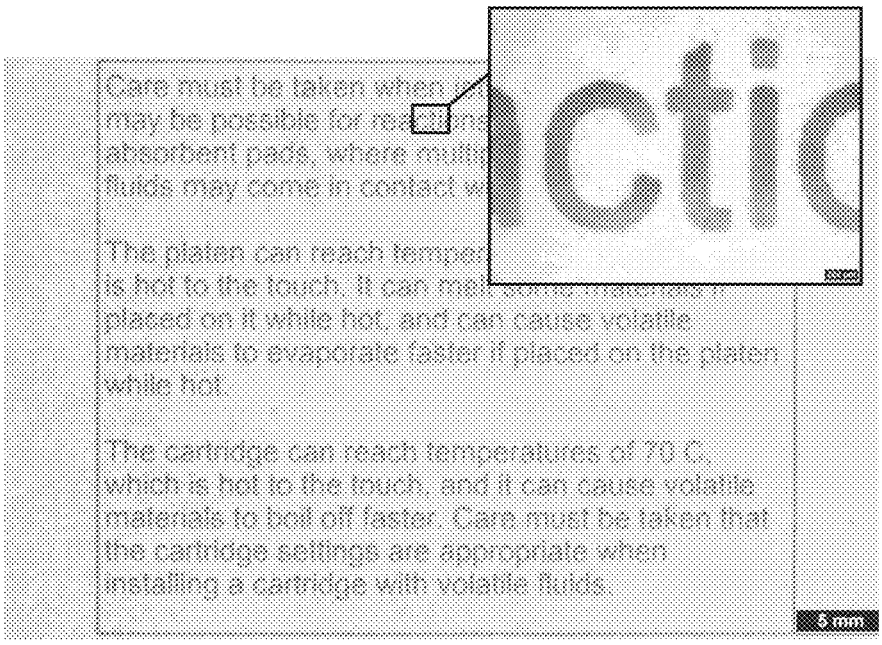
FIG. 1 shows a text, which was inkjet printed according to the method of the present invention by employing an inkjet formulation comprising a liquid treatment composition and an ink, and a magnified section thereof recorded with an optical microscope.

The prepared inkjet prints were examined by a Leica MZ16A stereomicroscope (Leica Microsystems Ltd., Switzerland).

2. Materials

Salifiable Alkaline Earth Compounds

CC1: ground calcium carbonate ($d_{50}$: 0.7 μm, $d_{98}$: 5 μm), pre-dispersed slurry with solids content of 78%, commercially available from Omya AG, Switzerland.

CC2: ground calcium carbonate ($d_{50}$: 0.6 μm, $d_{98}$: 4 μm), pre-dispersed slurry with solids content of 71.5%, commercially available from Omya AG, Switzerland.

CC3: ground calcium carbonate ($d_{50}$: 1.5 μm, $d_{98}$: 10 μm), pre-dispersed slurry with solids content of 78%, commercially available from Omya AG, Switzerland.

CC4: ground calcium carbonate ($d_{50}$: 0.5 μm, $d_{98}$: 3 μm), pre-dispersed slurry with solids content of 78%, commercially available from Omya AG, Switzerland.

KA1: pre-dispersed kaolin slurry with solids content of 72%, fineness: residue on a 45 μm sieve (ISO 787/7), particles <2 μm (Sedigraph 5120), commercially available from Omya AG, Switzerland.

Binders

B1: Starch (C*-Film 07311), commercially available from Cargill, USA.

B2: Styrene-butadiene latex (Styronal D628), commercially available from BASF, Germany.

Inkjet Formulations and Inks

F1: 41 wt.-% phosphoric acid, 23 wt.-% ethanol, 35 wt.-% water, and 1 wt.-% gardenia blue (product number OP0154, commercially available from Omya Hamburg GmbH, Germany) (wt.-% are based on the total weight of the inkjet formulation).

F2: 41 wt.-% phosphoric acid, 23 wt.-% ethanol, 35 wt.-% water, and 0.1 wt.-% amaranth red (product code 06409, commercially available from Fluka, Sigma-Aldrich Corp., USA) (wt.-% are based on the total weight of the inkjet formulations).

Ink 1: Black dye based ink (Océ KK01-E27 Black, commercially available from Océ Printing Systems GmbH & Co, KG, Germany), Solids content: 6.3 wt.-%, water content: 55.1 wt.-%, solvent content: 38.6 wt.-% (wt.-% are based on the total amount of the ink). The solvent consisted mainly of propylenglycol and butyldiglycol.

Ink 2: Black pigment based ink (Océ KK01-E27 Black, commercially available from Océ Printing Systems GmbH & Co. KG, Germany). Solids content: 6.5 wt.-%, water content: 47.7 wt.-%, solvent content: 45.8 wt.-% (wt.-% are based on the total amount of the ink). The solvent consisted mainly of diethylenglycol and butyldiglycol.

3. Examples

Example 1—Inkjet Printing of Letters and Two-Dimensional Bar Codes

A double coated baseboard having a basis weight of 300 g/m$^2$ was used as substrate. The pre-coat of the double coated baseboard had a coat weight of 15 g/m$^2$ and was composed of 80 pph CC3, 20 pph KA1, and 11 pph B2. The top coat of the double coated baseboard had a coat weight of 10 g/m$^2$ and was composed of 80 pph CC1, 20 pph KA1, and 12 pph B2.

The liquid treatment composition and the ink were deposited onto the coating layer simultaneously in form of inkjet formulation F1.

A text and a two-dimensional bar-code were created on the coating layer by inkjet printing using a Dimatix Materials Printer (DMP) of Fujifilm Dimatix Inc., USA, with a cartridge-based inkjet printhead having a drop volume of 10 pl. The print direction was from left to right, one row (line) at a time. The inkjet formulation F1 was applied onto the substrates with a drop volume of 10 pl and drop spacing of 25 μm. The print resolution was about 1000 dpi.

As a comparative example, the same text and two-dimensional bar code was inkjet printed onto the substrate by using a conventional inkjet ink (HP 364 magenta dye, Hewlett-Packard Company, USA) instead of the inkjet formulation of the present invention.

The results of said prints were inspected microscopically.

Figure 2:
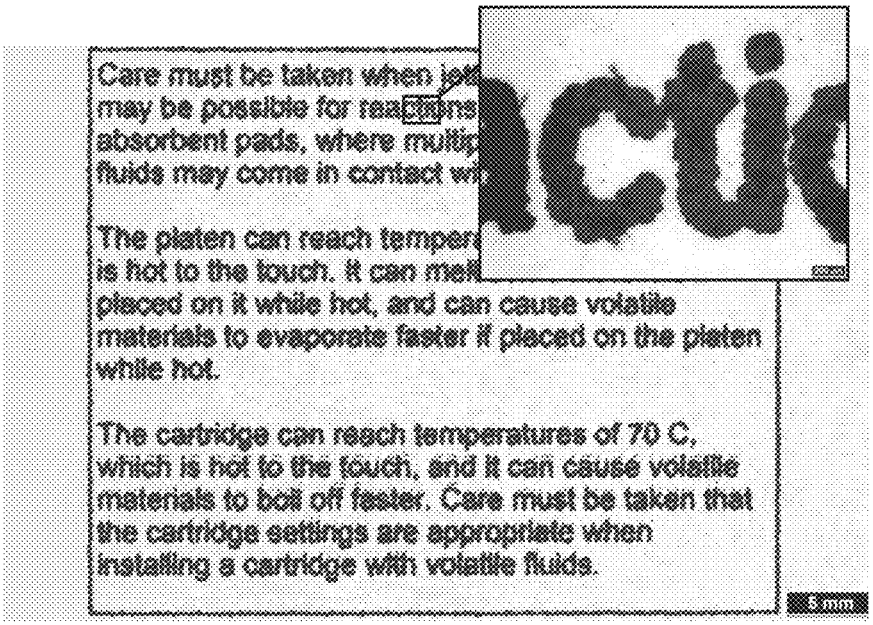
FIG. 2 shows a text, which was inkjet printed according to a conventional method using a conventional inkjet ink, and a magnified section thereof recorded with an optical microscope.
Figure 3:
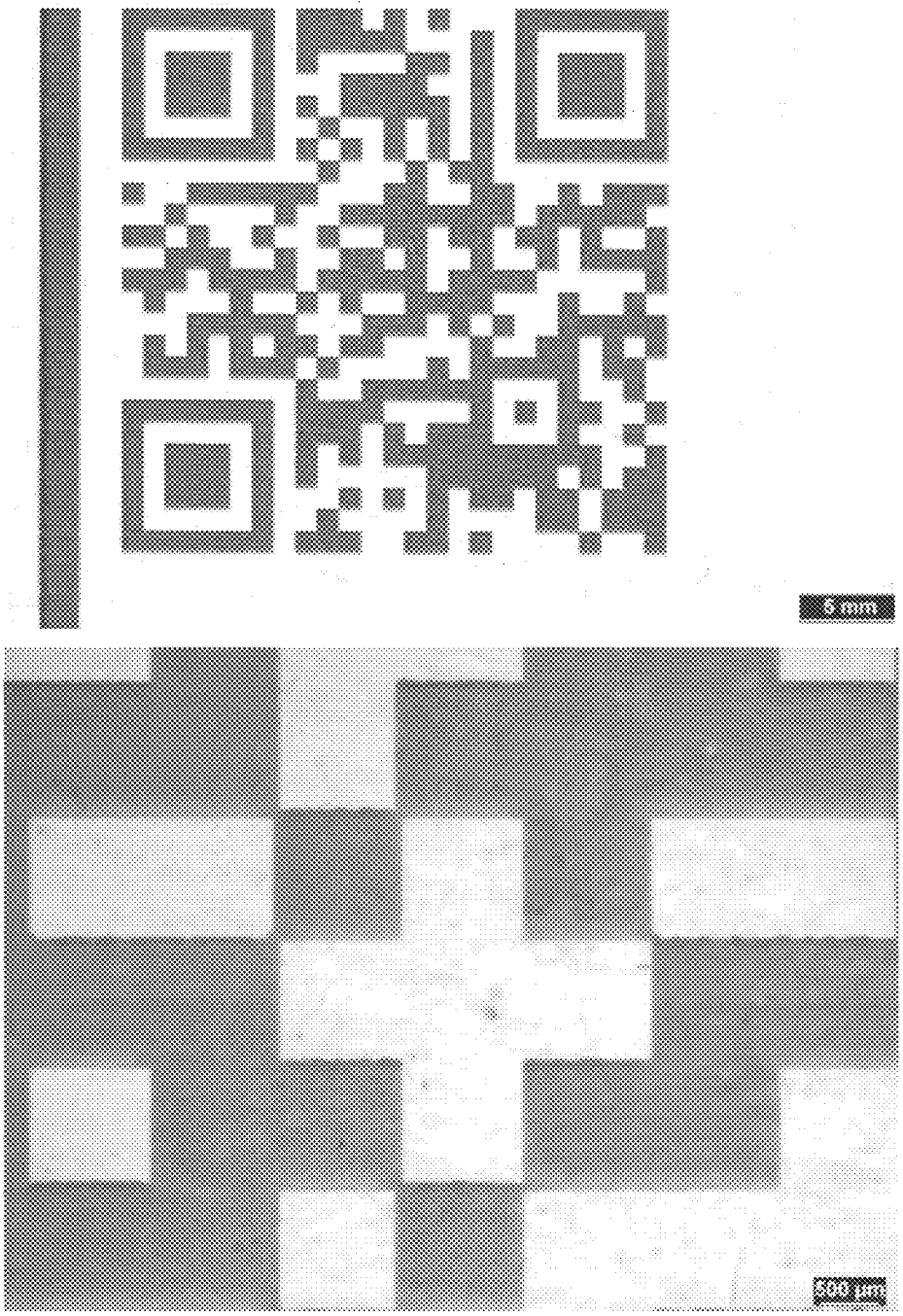
FIG. 3 shows a two-dimensional bar code, which was inkjet printed according to the method of the present invention (top) and a magnification thereof recorded with an optical microscope (bottom), wherein an inkjet formulation comprising a liquid treatment composition and an ink was used.
Figure 4:
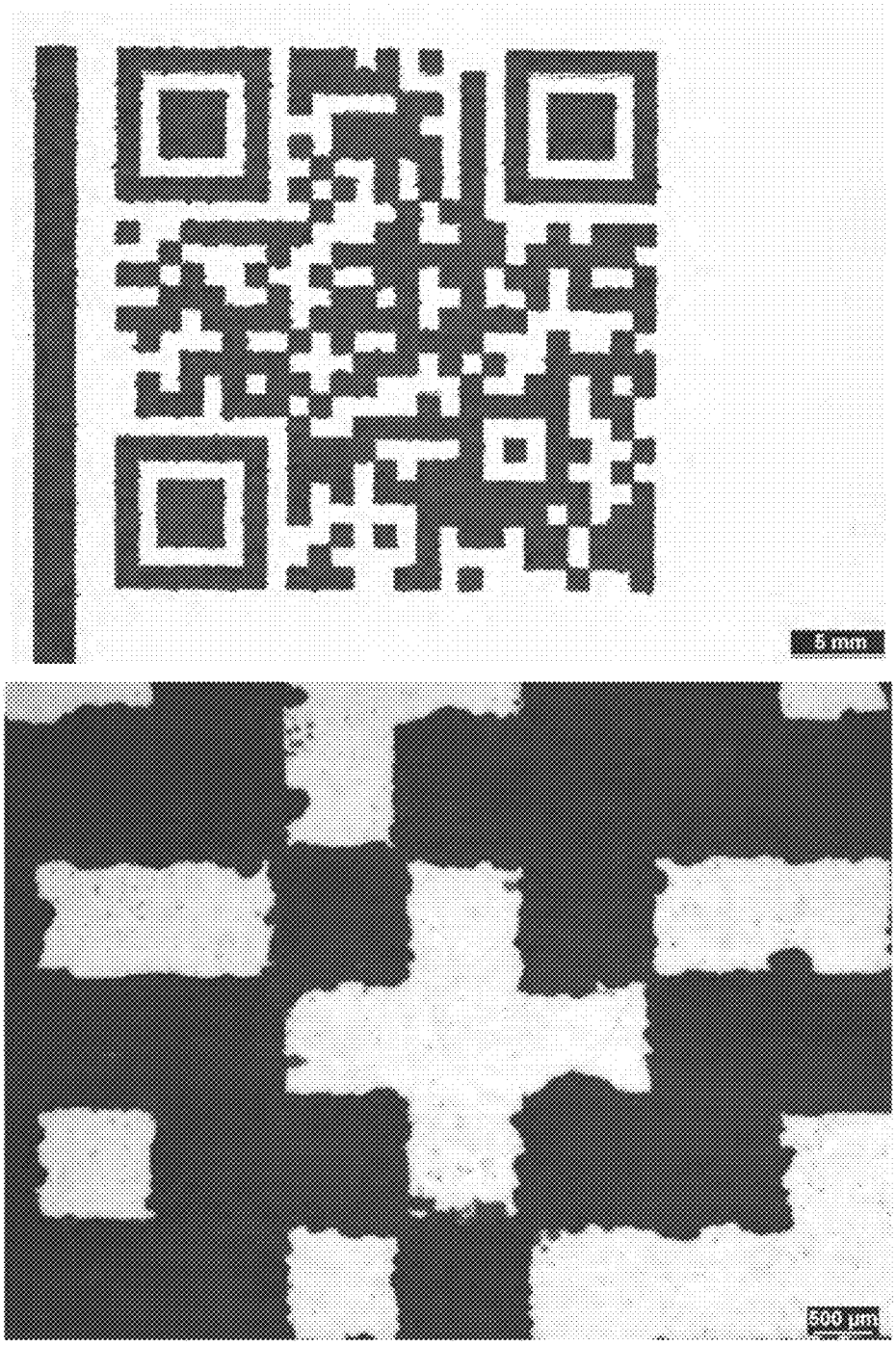
FIG. 4 shows a two-dimensional bar code, which was inkjet printed according to a conventional method using a conventional inkjet ink (top) and a magnification thereof recorded with an optical microscope (bottom).

FIGS. 1 to 4 show optical microscope images of the substrates that were printed with the inkjet formulation of the present invention and with the prior art inkjet ink. While a high quality print image with a clear and precise imprint is obtained by using the inventive inkjet formulation (FIG. 1), the printed image of the comparative print shown in FIG. 2 is degraded due to bleeding of the inkjet ink, which results in a poor print resolution. The same was observed for the printed two-dimensional bar code. The bar code printed by the inventive method, shown in FIG. 3 is clear, precise and has a high resolution, while the comparative print shown in FIG. 4 is degraded and of poor resolution.

Example 2—Inkjet Printing on Offset Paper

A low weight coated (LWC) offset paper (basis weight: 75 g/m$^2$) comprising a coating layer being composed of 70 pph of CC2, 30 pph KA1, 5 pph B2, and 3 pph B1 was used as substrate.

The liquid treatment composition and the ink were deposited onto the coating layer simultaneously in form of inkjet formulation F2.

A text was created on the coating layer by inkjet printing using a Dimatix Materials Printer (DMP) of Fujifilm Dimatix Inc., USA, with a cartridge-based inkjet printhead having a drop volume of 10 pl. The print direction was from left to right, one row (line) at a time. The inkjet formulation was applied onto the substrate with a drop volume of 10 pl and a drop spacing of 30 μm. The print resolution was 850 dpi.

Figure 5:
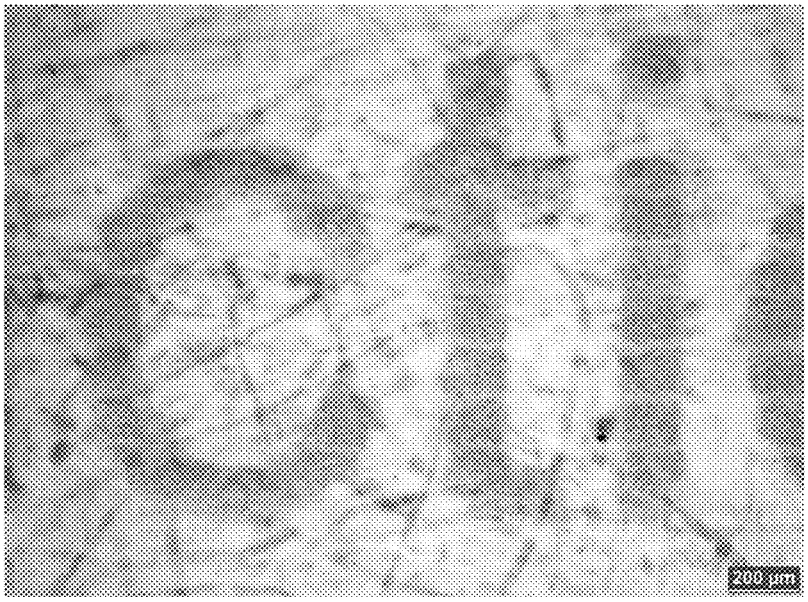
FIG. 5 shows an optical microscope picture of letters, which were inkjet printed according to the method of the present invention by employing an inkjet formulation comprising a liquid treatment composition and an ink.

The result of said print was inspected microscopically. As can be gathered from the microscope image shown in FIG. 5, a high quality print image with a clear and precise imprint was obtained with the inventive method.

Example 3—Inkjet Printing of Grids onto Square-Shaped Patterns

A double coated paper having a basis weight of 90 g/m$^2$ was used as substrate. The pre-coat of the double coated baseboard had a coat weight of 10 g/m$^2$ and was composed of 100 pph CC3, and 6 pph B2. The top coat of the double coated baseboard had a coat weight of 8.5 g/m$^2$ and was composed of 100 pph CC4, and 8 pph B2.

First and second patterns were created on the coating layer by inkjet printing using a Dimatix Materials Printer (DMP) of Fujifilm Dimatix Inc., USA, with a cartridge-based inkjet printhead having a drop volume of 10 pl. The print direction was from left to right, one row (line) at a time.

Firstly, a liquid treatment composition containing 41 wt.-% phosphoric acid, 23 wt.-% ethanol, and 36 wt.-% water (wt.-% are based on the total weight of the liquid treatment composition) was deposited onto a part of the coating layer in form of a square using a drop spacing of 20 μm (sample 1) or 30 μm (sample 2) in order to form a first pattern. Subsequently, ink 1 was deposited onto the substrate in form of a grid using a drop spacing of 25 μm in order to form a second pattern, wherein the grid was aligned such that it was printed within the square-shaped pattern as well as onto the remaining parts of the substrate, on which the square-shaped pattern was not present.

The results of the inkjet prints were inspected microscopically.

Figure 6:
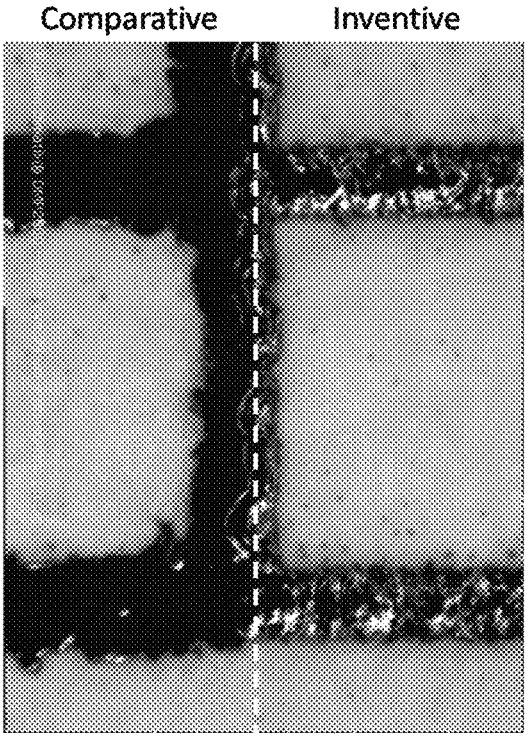
FIG. 6 shows an optical microscope picture of a grid, wherein the right part of the grid was inkjet printed according to the method of the present invention by depositing a liquid treatment composition and an ink consecutively.

FIG. 6 shows an optical microscope picture of sample 1, wherein the right part of the black second grid was deposited onto the first square-shaped pattern printed with the liquid treatment composition (inventive example). The left part of the black second grid was deposited directly onto the coating layer of the substrate (comparative example). While the right part of the grid is very clear and precise, the left part of the grid is broader and more frayed due to bleeding of the ink.

Figure 7:
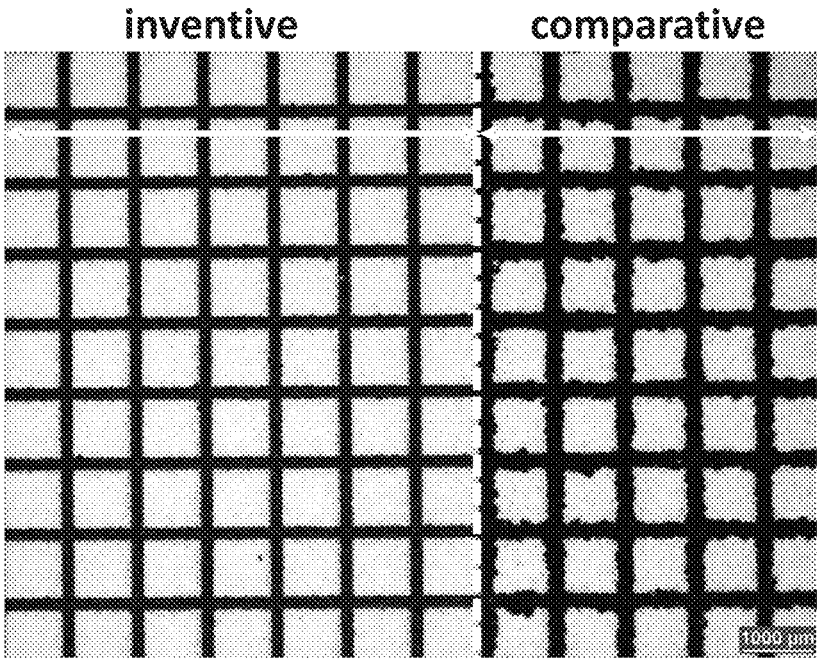
FIG. 7 shows an optical microscope picture of a grid, wherein the left part was inkjet printed according to the method of the present invention by depositing a liquid treatment composition and an ink consecutively.

FIG. 7 shows an optical microscope picture of sample 2, wherein the left part of the black second grid was deposited onto the first square-shaped pattern printed with the liquid treatment composition (inventive example). The right part of the black second grid was deposited directly onto the coating layer of the substrate (comparative example). While the left part of the grid is very clear and precise, the right part of the grid is broader and more frayed due to bleeding of the ink.

FIGS. 6 and 7 confirm that by applying the inventive method high quality inkjet prints with a clear and precise imprint can be formed.

Example 4—Inkjet Printing of a Grid onto a Grid

A double coated paper having a basis weight of 90 g/m$^2$ was used as substrate. The pre-coat of the double coated baseboard had a coat weight of 10 g/m$^2$ and was composed of 100 pph CC3, and 6 pph B2. The top coat of the double coated baseboard had a coat weight of 8.5 g/m$^2$ and was composed of 100 pph CC4, and 8 pph B2.

Grids were created on the coating layer by inkjet printing using a Dimatix Materials Printer (DMP) of Fujian Dimatix Inc., USA, with a cartridge-based inkjet printhead having a drop volume of 10 pl. The print direction was from left to right, one row (line) at a time.

Firstly, a liquid treatment composition containing 41 wt.-% phosphoric acid, 23 wt.-% ethanol, and 36 wt.-% water (wt.-% are based on the total weight of the liquid treatment composition was deposited onto a part of the substrate in form of a first grid using a drop spacing of 25 μm. Subsequently, ink 2 was deposited onto the substrate in form of a second grid using a drop spacing of 25 mm, wherein the second grid was aligned such that it was printed within the first grid.

Figure 8:
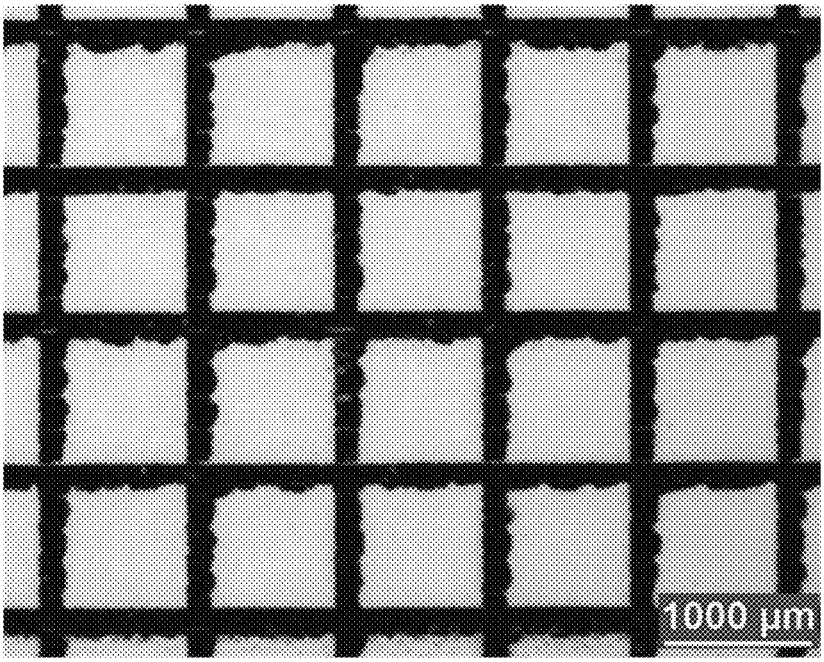
FIG. 8 shows an optical microscope picture of a grid, which was inkjet printed according to the method of the present invention by depositing a liquid treatment composition and an ink consecutively.

The result of the inkjet print was inspected microscopically. It can be gathered from FIG. 8 that due to a slight misalignment of the first and the second grid spreading of the ink downwards and rightwards was observed. No spreading upwards and leftwards was observed since those edges of the second grid are formed on the first grid. Thus, FIG. 8 confirms that by applying the inventive method high quality inkjet prints with a clear and precise imprint can be formed.

The invention claimed is:

1. A method for manufacturing an inkjet-printed substrate comprising the following steps:

a) providing a substrate, wherein the substrate comprises on at least one side a coating layer comprising a salifiable alkaline or alkaline earth compound, b) providing a liquid treatment composition comprising an acid that forms $CO_2$ when it reacts with a salifiable alkaline or alkaline earth compound, c) providing an ink, d) depositing the liquid treatment composition onto the coating layer by inkjet printing so that the acid in the liquid treatment composition reacts with the salifiable alkaline or alkaline earth compound in the coating layer and forms a first pattern, and e) depositing the ink onto the coating layer by inkjet printing to form a second pattern, wherein the liquid treatment composition and the ink are deposited simultaneously or consecutively and the first pattern and the second pattern overlap at least partially.

2. The method of claim 1, wherein the first pattern and the second pattern overlap by at least 50%.

3. The method of claim 1, wherein the first pattern and the second pattern overlap by at least 90%.

4. The method of claim 1, wherein the first pattern and the second pattern overlap by at least 95%.

5. The method of claim 1, wherein the substrate of step a) is prepared by:

i) applying a coating composition comprising a salifiable alkaline or alkaline earth compound on at least one side of the substrate to form a coating layer, and ii) drying the coating layer.

6. The method of claim 1, wherein the substrate is selected from the group consisting of paper, cardboard, containerboard, plastic, non-wovens, cellophane, textile, wood, metal, glass, mica plate, marble, calcite, nitrocellulose, natural stone, composite stone, brick, concrete, laminates, and any composites thereof.

7. The method of claim 1, wherein the substrate is paper, cardboard, containerboard, or plastic.

8. The method of claim 1, wherein the salifiable alkaline or alkaline earth compound is an alkaline or alkaline earth oxide, an alkaline or alkaline earth hydroxide, an alkaline or alkaline earth alkoxide, an alkaline or alkaline earth methylcarbonate, an alkaline or alkaline earth hydroxycarbonate, an alkaline or alkaline earth bicarbonate, an alkaline or alkaline earth carbonate, or any mixture thereof.

9. The method of claim 1, wherein the salifiable alkaline or alkaline earth compound is an alkaline or alkaline earth carbonate.

10. The method of claim 1, wherein the salifiable alkaline or alkaline earth compound is lithium carbonate, sodium carbonate, potassium carbonate, magnesium carbonate, calcium magnesium carbonate, calcium carbonate, or any mixture thereof.

11. The method of claim 1, wherein the salifiable alkaline or alkaline earth compound is a ground calcium carbonate, a precipitated calcium carbonate, a surface-treated calcium carbonate, or any mixture thereof.

12. The method of claim 1, wherein the salifiable alkaline or alkaline earth compound is in form of particles having a weight median particle size $d_{50}$ from 15 nm to 200 μm.

13. The method of claim 1, wherein the salifiable alkaline or alkaline earth compound is in form of particles having a weight median particle size $d_{50}$ from 50 nm to 50 μm.

14. The method of claim 1, wherein the salifiable alkaline or alkaline earth compound is in form of particles having a weight median particle size $d_{50}$ from 100 nm to 2 μm.

15. The method of claim 1, wherein the acid is selected from the group consisting of hydrochloric acid, sulphuric acid, sulphurous acid, phosphoric acid, citric acid, oxalic acid, acetic acid, formic acid, sulphamic acid, tartaric acid, phytic acid, boric acid, succinic acid, suberic acid, benzoic acid, adipic acid, pimelic acid, azelaic acid, sebaic acid, isocitric acid, aconitic acid, propane-1,2,3-tricarboxylic acid, trimesic acid, glycolic acid, lactic acid, mandelic acid, acidic organosulfur compounds, acidic organophosphorus compounds, and any mixture thereof.

16. The method of claim 1, wherein the acid is selected from the group consisting of hydrochloric acid, sulphuric acid, sulphurous acid, phosphoric acid, oxalic acid, boric acid, suberic acid, succinic acid, sulphamic acid, tartaric acid, and any mixture thereof.

17. The method of claim 1, wherein the acid is phosphoric acid, sulphuric acid, or a mixture thereof.

18. The method of claim 1, wherein the liquid treatment composition comprises the acid in an amount from 0.1 to 100 wt.-%, based on the total weight of the liquid treatment composition.

19. The method of claim 1, wherein the liquid treatment composition comprises the acid in an amount from 1 to 80 wt.-%, based on the total weight of the liquid treatment composition.

20. The method of claim 1, wherein the liquid treatment composition comprises the acid in an amount from 10 to 50 wt.-%, based on the total weight of the liquid treatment composition.

21. The method of claim 1, wherein the liquid treatment composition is deposited onto the coating layer in form of a one-dimensional bar code, a two-dimensional bar code, a three-dimensional bar code, a security mark, a number, a letter, an alphanumerical symbol, a text, a logo, an image, a shape, or a design.

22. An inkjet-printed substrate formed by the method according to claim 1.

23. A wall paper, packaging product, a decorative product, an artistic product, a gift wrap paper product, an advertisement paper or poster, a business card, a manual, a warranty sheet or card comprising the substrate according to claim 22.

* * * * *